US006774566B2

(12) United States Patent
Honda et al.

(10) Patent No.: US 6,774,566 B2
(45) Date of Patent: Aug. 10, 2004

(54) HIGH PRESSURE DISCHARGE LAMP AND LUMINAIRE

(75) Inventors: Hisashi Honda, Kanagawa-ken (JP); Seiji Ashida, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 10/191,054

(22) Filed: Jul. 10, 2002

(65) Prior Publication Data

US 2003/0076041 A1 Apr. 24, 2003

(30) Foreign Application Priority Data

Sep. 19, 2001 (JP) ..... P2001-284841
Sep. 19, 2001 (JP) ..... P2001-284842

(51) Int. Cl.[7] ..... H01J 61/30
(52) U.S. Cl. ..... 313/634; 313/623; 315/58
(58) Field of Search ..... 313/634, 637–642, 313/623; 315/291, 307, 224, 56, 58, 248

(56) References Cited

U.S. PATENT DOCUMENTS 5,998,939 A * 12/1999 Fellows et al. ..... 315/246
6,342,764 B1 * 1/2002 Nishiura et al. ..... 313/631
6,495,960 B1 * 12/2002 Takeji et al. ..... 313/634
6,573,656 B2 * 6/2003 Kaneko et al. ..... 313/623
6,586,881 B1 * 7/2003 Miyazawa et al. ..... 313/634
6,621,219 B2 * 9/2003 Allen et al. ..... 313/623

* cited by examiner

*Primary Examiner*—Don Wong
*Assistant Examiner*—Ephrem Alemu
(74) *Attorney, Agent, or Firm*—Pillsbury Winthrop LLP

(57) ABSTRACT

A high pressure discharge lamp comprises a light-transmissive ceramic discharge vessel having a swollen portion defining a discharge space and a pair of slender cylindrical portions formed in integral with the swollen portion and communicating with the swollen portion at opposite ends of the swollen portion, wherein the inner surface of the boundary portion between the swollen portion and the each slender cylindrical portion defines a discontinuous inflection, and a pair of the electrodes which penetrate the slender cylindrical portions of the light-transmissive ceramic discharge vessel and lie in the swollen portion of the light-transmissive ceramic discharge vessel at their distal ends, lead-conductors connected to the proximal ends of the electrodes, sealed in the light-transmissive ceramic discharge vessel at least at their mid-portions and exposing outside from the light-transmissive ceramic discharge vessel at their proximal ends, and a filling filled in the light-transmissive ceramic discharge vessel.

5 Claims, 14 Drawing Sheets

HIGH PRESSURE DISCHARGE LAMP AND LUMINAIRE

CROSS-REFERENCE TO RELATED APPLICATIONS

This application is based upon and claims the benefit of priority from the prior Japanese Patent Applications JP2001-284841 and JP2001-284842 both filed on Sep. 19, 2001, the entire contents of which are incorporated herein by reference.

BACKGROUND

The inventions described herein relate to a high pressure discharge lamp which is provided with a light-transmissive discharge vessel made of ceramics (hereinafter, referred to as light-transmissive ceramic discharge vessel) and a luminaire using such a high pressure discharge lamp.

In recent years, a metal halide lamp equipped with a light-transmissive ceramic discharge vessel has been in widespread use. Such a metal halide lamp has features that the color temperature change and the dispersion of colors in lifetime are scarce in compared with a metal halide lamp equipped with a conventional silica glass discharge vessel, in addition to the features of having a longer life-expectancy and a high lighting efficiency Conventional light-transmissive ceramic discharge vessels used for high pressure discharge lamps (prior-art I), such as metal halide lamps equipped with a light-transmissive ceramic discharge vessel, often have a structure wherein a cylindrical portion, a large-diameter cylindrical portion, and a tubular portion are assembled by shrink-fitting. In this configuration, a tubular portion forms slender cylindrical portion for the swollen portion in which, as for a light-transmissive ceramic discharge vessel, a cylindrical portion and a large-diameter cylindrical portion surround discharge space, respectively. The high pressure discharge lamp equipped with the configuration of light-transmissive ceramic discharge vessel has little change of the color-temperature when changing the lighting position. This is because the change of the coldest portion temperature is small. In the conventional high pressure discharge lamp as mentioned above, the coldest portion is defined in the vicinity of the end of a tubular portion. The temperature of this portion is determined by the balance of the conductive heat and the radiant heat from the electrodes, and the conductive heat from the light-transmissive ceramic discharge vessel. Although the conductive heat and the radiant heat from the electrodes hardly change when the lighting position is changed, the amount of heat conduction from the light-transmissive ceramic discharge vessel changes extensively. That is, at a horizontal position lighting, an arc bends upwards and approaches the wall of upper portion of the light-transmissive ceramic discharge vessel. Thus the upper portion is strongly heated. Meanwhile, the heat conductivity of ceramics, such as a light transmissive alumina used for the light-transmissive ceramic discharge vessel, is significantly high as compared with that of silica glasses Therefore, it is normal to expect that an amount of heat conducted to the end of the slender cylindrical portion where occurs the coldest portion increases, the temperature of the coldest portion rises and thus the color temperature changes. However, the shrinkage fitting portion of the light-transmissive ceramic discharge vessel works as a heat resistance thus limiting in some degree the amount of heat transferred to the slender cylindrical portion where occurs the coldest portion, suppressing the change of the color temperature at a practically allowable level. This is the reason why the change of the color temperature is small when changing the lighting position, that is, the lighting position property is favorable.

On the other hand, in reference document II as disclosed in the Japanese Patents JP9-147803 and JP 11 204086, a light-transmissive ceramic discharge vessel is constructed in one piece by a cast-molding. This type of discharge vessel has a tendency that the heat capacitance goes relatively low. The reference document II is advantageous for keeping favorable the temperature of the coldest portion due to its nature having the relatively low heat capacitance. However, the reference document II still has a problem due to that the heat conductivity of the light-transmissive ceramic discharge vessel is significantly high.

Moreover, the reference document II falls into two categories, i.e., one that the inner surface and the outer surface of the discharge vessel are defined in gently continuous curves at the boundary portion between the swollen portion and the slender cylindrical portion, and another that the inner surface and the outer surface of the discharge vessel are defined in discontinuous inflected surfaces at the boundary portion between the swollen portion and the slender cylindrical portion.

Meanwhile, when lighting the high pressure discharge lamp with a high frequency current, it is necessary to avoid an acoustic resonance and. To that end, it is desirable to unify acoustic resonance modes of the light-transmissive ceramic discharge vessel. In order to realize the unification of the acoustic resonance modes, it is necessary to shape the inner wall of the swollen portion of a light-transmissive ceramic discharge vessel in spherical. However, in the reference document II, particularly the one having a uniform thickness at the swollen portion of the light-transmissive ceramic discharge vessel and a nearly spherical shape, as shown in the Japanese laid-open patent JP9-147803, a discontinuous inflection is defined in both of the inner and the outer surfaces around the boundary portion between the swollen portion and the slender cylindrical portion. Furthermore, since the electrode reaching a high temperature during lamp operation is located near the inflecting portion, a serious thermal stress occurs in the inflecting portion. Thus, there were problems that the slender cylindrical portion is broken during manufacturing, or a crack easily occurs during lamp operation. As a result of studying measures for solving the problems, the present inventors have found that when the inner surface and the outer surface of the discharge vessel are defined in gently continuous curves at the boundary portion between the swollen portion and the slender cylindrical portion, the mechanical strength of the boundary portion is improved and thus the problems can be eliminated.

In the shrink-fit structure shown in reference document I there is a tendency that a heat capacitance relatively increases. Therefore, when lamp wattage being reduced, there is a problem that it is impossible to maintain the coldest portion in a temperature required for securing high efficiency.

Further, the structure in that the inner surface and the outer surface of the discharge vessel are defined in gently continuous curves at the boundary portion between the swollen portion and the slender cylindrical portion in the prior-art II also fail to solve the problem regarding the lighting position property. That is, since when the inner and the outer surfaces around the boundary portion between the swollen portion and the slender cylindrical portion are both continuous surfaces the conductive heat and the convective heat during lamp operation become easy to be transferred to the coldest portion through the boundary, the problem of the lighting position property becomes serious. When increasing the amount of a metallic halide in the discharge vessel to reduce the problem of the lighting position property, it is effective since the metallic halide becomes hard to move when changing the lighting position. However, this causes an opposite difficulty that impurities, such as $H_2O$, becomes easy to mix into the metallic halide, thus remarkably deteriorating the lamp property during life.

Our inventors have found that when a starting-aid conductor, i.e., a metal coil having the same potential as the opposite side the electrode is wound on a slender cylindrical portion, a weak discharge occurs across the coil and the electrode penetrating the slender cylindrical portion at the start of operation and thus the starting operation is aided.

In this configuration, a capacitive coupling is formed between the starting-aid conductor and the electrode surrounded by the starting-aid conductor. Then, a precursive week discharge occurs through the capacitive coupling, and promotes the starting operation. The capacitance of the electrostatic coupling is effective to achieve a proper glow-arc transition time (0.5–3 seconds). However, the above configuration has a problem that when a week discharge has occurred, a thermal shock is given to the boundary portion between the swollen portion and the slender cylindrical portion. Thus, there is a problem that a crack is easy to occur on the boundary portion.

Furthermore, by providing starting-aid conductors on the pair of slender cylindrical portions of the light-transmissive ceramic discharge vessel, respectively, it is expected that the property will be further improved. However, actual glow-arc transition times at the pair of the electrodes are different each other if the coil turns of the starting-aid conductors are equalized each other. Accordingly, the electrode in the side related to the shorter glow-arc transition time is fed a power required for the glow-arc transition in a short time. Accordingly, the electrode is overheated and then the evaporation or the electrode material increases. As a result, there arises a problem that a blackening occurs on the light-transmissive ceramic discharge vessel.

SUMMARY

Our inventions provide a high pressure discharge lamp provided with a light-transmissive ceramic discharge vessel which maintains the coldest portion temperature to an optimal value, and suppresses a color-temperature change accompanying the change of lighting position, and a luminaire using such a high pressure discharge lamp.

Our inventions also provide a high pressure discharge lamp which makes easy to avoid acoustic resonance by simplifying the acoustic resonance modes of the light-transmissive ceramic discharge vessel, and hard to cause cracks by thermal stresses on the boundary portion between the swollen portion and the slender cylindrical portion of the light-transmissive ceramic discharge vessel, and a luminaire using such a high pressure discharge lamp.

Our inventions also provide a high pressure discharge lamp which makes hard to cause cracks by thermal stresses according to a precursive week discharge occurred by a starting-aid coil wound on the slender cylindrical portion, and a luminaire using such a high pressure discharge lamp.

Our inventions also provide a high pressure discharge lamp which suppresses a blackening easily occurring on the light-transmissive ceramic discharge vessel by a starting-aid coil wound on the slender cylindrical portion, and a luminaire using such a high pressure discharge lamp.

In one respect the high pressure discharge lamp comprises a light-transmissive ceramic discharge vessel having a swollen portion defining a discharge space and a pair of slender cylindrical portions formed in integral with the swollen portion and communicating with the swollen portion at opposite ends of the swollen portion, wherein the inner surface of the boundary portion between the swollen portion and the each slender cylindrical portion defines a continuous curved surface, a pair of electrodes, wherein one of the pair electrodes penetrating the respective one of the pair slender cylindrical portion of the light-transmissive ceramic discharge vessel and lie in the swollen portion of the light-transmissive ceramic discharge vessel at their distal ends, lead-conductors connected to the proximal ends of the electrodes, sealed in the light-transmissive ceramic discharge vessel at least at their mid-portions and exposing outside from the light-transmissive ceramic discharge vessel at their proximal ends, and a filling filled in the light-transmissive ceramic discharge vessel.

Still another aspect of the high pressure discharge lamp according to our inventions is further characterized by that the minimum wall-thickness Tmin of the light-transmissive ceramic discharge vessel is equal to or more than 0.1 mm, and the inner diameter D of the swollen portion and the curvature radius R of the concave outer surface around the boundary portion between the swollen portion and the slender cylindrical portion satisfies an equation $0.1 \leqq R/D \leqq 1.5$.

Still another aspect of the high pressure discharge lamp according to our inventions is that the minimum wall-thickness Tmin of the light-transmissive ceramic discharge vessel is equal to or more than 0.3 mm, and the inner diameter D of the swollen portion and the curvature radius R of the concave outer surface around the boundary portion between the swollen portion and the slender cylindrical portion satisfies an equation $0.1 \leqq R/D \leqq 1.5$.

Still another aspect of the high pressure discharge lamp according to our inventions is that the inner diameter D of the swollen portion and the curvature radius R of the concave outer surface around the boundary portion between the swollen portion and the slender cylindrical portion satisfies a following equation $0.1 \leqq R/D \leqq 1.5$, the rated lamp wattage is equal to or less than 50W, and the rated lighting frequency is in the range of 15 to 30 kHz or the range of 40 to 50 kHz.

We also provide a luminaire including a luminaire main-body, a high pressure discharge lamp with a rated lamp wattage equal to or less than 50 W and a configuration as defined in any one of the above aspects of the high pressure discharge lamps, which is mounted on the luminaire main-body, and a lighting circuit for driving the high pressure discharge lamp, at a rated lighting frequency in the range of 15 to 30 kHz or the range of 40 to 50 kHz.

In this application, some definitions and their technical meanings are presented for following specific terms, unless otherwise specified.

Light-Transmissive Ceramic Discharge Vessel

The term "light-transmissive ceramic discharge vessel" means a hermetic discharge lamp swollen portion comprised of a mono-crystalline metal oxide, e.g., a sapphire, a poly-crystalline metal oxide, e.g., a semi-transparent aluminum oxide, and yttrium-aluminum garnet (YAG), an yttrium oxide (YOX) and a polycrystalline non-oxidic material, e.g., a material having a light-transmissivity and heat-resistancy like aluminum nitride (AIN). Here, the term "light-transmissive" means a transmissivity allowing light generated by a discharge to be led outside. Accordingly the term may include not only a transparency but also a light-diffusiveness. In addition, it is essential that at least the swollen portion has a transmissivity. While if required the small-diameter cylinder may have a light blocking effect.

Moreover, the light-transmissive ceramic discharge vessel is provided with a swollen portion defining a discharge space and slender cylindrical portions communicating with the swollen portion at opposite ends of the swollen portion. And the swollen portion and the slender cylindrical portions are united in one piece. Therefore, there is no heterogeneous structure in the glass material section by shrink-fitting. Since the swollen portion defines a discharge space, the inner surface of the swollen portion can be a continuous curved surface. Furthermore, the principal part of the inner surface of the swollen portion can be made into a spherical hollow. It is desirable that the "sphere" is a perfect sphere since in such a perfect sphere an acoustic-resonance frequency becomes a single mode. However, the inner surface can be an oval sphere if required. In addition, the "principal part" of the swollen portion denotes a residual major part of the swollen portion except the end portion next to the slender cylindrical portion, where the discharge light principally transmits there-through.

Secondly, the thin cylinder portion contributes to secure a coldest portion therein by leaving a narrow gap so-called a capillary between a later described the electrode penetrating inside the thin cylinder portion, and to seal the swollen portion. The inner diameter of the thin cylinder portion is preferable to be equal to or less than 1 mm for lowering the thermal capacitance as much as possible. It is more preferable that the inner diameter is equal to or less than 0.8 mm. In addition, the section of the slender cylindrical portion is preferable to be approximately round shape.

According to one aspect of the inventions, the boundary portion between the swollen portion and the slender cylindrical portion of the light-transmissive ceramic discharge vessel defines the discontinuous inflection. Then, it becomes possible to constitute the swollen portion in an almost spherical shape. Consequently acoustic-resonance frequency is simplified. In case of lighting a high pressure discharge lamp with a high frequency current, the operation frequency is conventionally set to fall in a frequency band which exists between the secondary and tertiary harmonics of the acoustic-resonance frequency. According to this aspect of the invention, the frequency band spreads in the range of 9 to 10 kHz which is broader by about 2 kHz than that of the conventional case. Thereby, the design of the high frequency lighting circuit becomes easy. Here, the term "almost spherical shape" means substantial spherical. That is, some extent of deformation occurring in manufacturing process is permitted.

However, it is more favorable that the inner wall of the swollen portion has a sphericity of 0.53 or more.

Referring now to FIG. 1, the term "sphericity" will be described.

FIG. 1 is a drawing for explaining the sphericity of the swollen portion of the light-transmissive ceramic discharge vessel in the high pressure discharge lamp according to the present invention. In FIG. 1, the numeral "1" denotes a light-transmissive ceramic discharge vessel. The numeral "1*a*" denotes a swollen portion. The numeral "1*b*" denotes a thin portion. The letter "X" denotes a central axis. And the letter "Y" denotes an axis orthogonal to the central axis X.

The swollen portion 1*a* has a maximum inner diameter D along the axis Y, and an axial length La along the central axis X. Further, let the intersection of the axis Y and the inner surface of the swollen portion 1*a* be "P1", and let the point where the line extending from the intersection P1 towards the central axis X touching internally with the boundary portion between the swollen portion 1*a* and the slender cylindrical portion 1*b* be P2. When letting further the right and left two intersections where the line 1 extending between the intersections P1 and P2 intersects the central axis X be P3, the axial length La of the swollen portion 1*a* is given by the distance between the right and left intersections P3, P3.

Then the sphericity IG of the swollen portion 1*a* is given by a following equation, from the maximum inner diameter D and the axial length La.

$$IG=D/La$$

Meanwhile, the sphericity IG is determined by the mean value of the maximum value and the minimum value among the values obtained for a plural locations around the central axis X.

According to that in this aspect of the invention the sphericity IG of the swollen portion of the light-transmissive ceramic vessel is 0.53 or more, the fundamental acoustic-resonance frequency is simplified. Therefore, when the high pressure discharge lamp according to this aspect of the present invention which is manufactured by using the above configuration of the light-transmissive ceramic discharge vessel, it becomes easy to light the high pressure discharge lamp at a frequency getting out of the acoustic-resonance frequency. That is, it become possible to light the high pressure discharge lamp at a specific high frequency. Meanwhile, a desirable sphericity is in the range of 0.53 to 0.85, and a more preferable sphericity is in the range of 0.57 to 0.82.

Meanwhile, still another aspect of the high pressure discharge lamp is characterized by that the wall-thickness ratio Tmin/Tmax of the minimum wall-thickness Tmin and the maximum wall-thickness Tmax of the light-transmissive ceramic discharge vessel is restricted to 0.75. If the wall-thickness ratio Tmin/Tmax exceeds 0.75, a required degree of heat accumulation effect fails to obtained. By the way, the wall-thickness ratio Tmin/Tmax is favorable to be 0.65 or less. Thereby, the color-temperature change at the time of changing the lighting position decreases further.

Here, it is more preferable that the wall-thickness ratio Tmin/Tmax of the minimum wall-thickness Tmin and maximum wall-thickness Tmax is regulated to 0.1 or more. Since the heat capacitance of the light-transmissive ceramic discharge vessel becomes excessive when the wall-thickness ratio Tmin/Tmax is less than 0.1, the rising time of the luminous flux at the start of operation becomes slower. Hence, the wall-thickness ratio Tmin/Tmax should not be less than 0.1.

The locations of the thinnest wall portion and the thickest wall portion are not especially restricted. However, it is most reasonable for manufacturing that the location of the thinnest wall portion lies around the portion where the swollen portion has the maximum diameter. It is also most reasonable that the location of the thickest wall portion lies around the boundary of the swollen portion and the slender cylindrical portion. Moreover, the locations of the thinnest wall portion and the thickest wall portion are relative with each other. That is, they do not take any particular importance for achieving the objects of the present invention. However, the minimum wall-thickness must take a value which exhibits a mechanical strength capable of standing against the pressure of the filling in the discharge vessel during the operation of the high pressure discharge lamp. By the way, the thinnest wall portion has a relatively high light transmittance. Therefore, according to that the portion around the widest portion of the swollen portion takes the minimum wall-thickness and thus the effective amount of light passing through that portion is relatively large, the widest portion exhibits a high luminous efficiency. Here, the term "effective amount of light" means the amount of light usable for illumination among the light radiated from a high pressure discharge lamp.

On the other hand, it is effective that the thickest wall portion lies in the swollen portion, not but in the slender cylindrical portion since the cross-sectional area of the wall of the swollen portion is relatively larger than that of the slender cylindrical portion, and thus takes a large thermal capacitance. While, the thickest wall portion takes a relatively low light transmittance. Accordingly, when giving greater importance to the luminous efficacy it is preferable that the thickest wall portion lies on a location where the available amount of light passes there-through as small as possible. For example, the above configuration can be achieved by locating the thickest wall portion around the boundary of the swollen portion and the slender cylindrical portion. In this configuration, an effect that the mechanical strength of the boundary portion between the swollen portion and the slender cylindrical portion increases is also achieved. Furthermore, since the thickest wall portion is thicker than a wall-thickness exhibiting a mechanical strength capable of standing against the pressure of the filling in the discharge vessel, in general the thickest wall portion is able to be provided by incrementally forming itself.

Moreover, the wall-thickness of the thin cylinder portion is allowed to change at the inflection as a border. Since the inflection causes a steep change of wall-thickness in the slender cylindrical portion of the light-transmissive ceramic discharge vessel, and thus a thermal resistance increases. Thereby, the injection suppresses a heat transfer from the swollen portion to the slender cylindrical portion. Therefore, it becomes easy to control the temperature of the coldest portion. Meanwhile, when the inflection is formed around the boundary portion between the swollen portion and the slender cylindrical portion, it will be easy to manufacture the light-transmissive ceramic discharge vessel.

Meanwhile, in this aspect of the high pressure discharge lamp, the overall length and the internal volume of the light-transmissive ceramic discharge vessel are not especially restricted. However, assuming to achieve a compact high pressure discharge lamp with a 10 to 50 W lamp wattage, the overall length L is desirable to be 35 mm or less, more preferably be 10 to 30 mm. Moreover, the internal volume is favorable to be 0.10 cc or less, and more particularly 0.01 to 0.08 cc.

Under the favor of that this aspect of the invention has the above configuration, the high pressure discharge lamp is able to lower an amount of heat given from an arc to the swollen portion at a horizontal position lighting by appropriately expanding the distance between the midsection of the curvature of the arc and the inner surface of the swollen portion facing thereto.

Meanwhile, further to the above feature of the light-transmissive ceramic discharge vessel, this invention is still structurally featured by that the outer surface of the boundary portion between the swollen portion and the slender cylindrical portion defines a continuous concave surface, other than that the inner surface of the boundary portion between the swollen portion and the slender cylindrical portion defines a discontinuous inflection. The curvature of the concave surface is not especially restricted. However, when letting the curvature radius of concave be R and the maximum inner diameter of the swollen portion be D, it is more effective that they satisfy a following equation.

$$0.1 \leqq R/D \leqq 1.5$$

If the ratio R/D in less than 0.1, the mechanical strength of the boundary portion becomes week, and thus the slender cylindrical portion not only tends to break during manufacturing, but also tends to suffer with cracks due to heat cycle in lifetime. Moreover, if the ratio R/D exceeds 1.5, medium such as mercury for fixing lamp voltage in the filling becomes hard to be cooled effectively. Thus, problems tend to arise in manufacturing process.

Furthermore, by letting the inner diameter D and the overall length L of the swollen portion of the light-transmissive ceramic discharge vessel satisfy a following equation, an occurrence of leak in the light-transmissive ceramic discharge vessel is suppressed while maintaining required lamp property.

$$0.1 < D/L < 0.3$$

When the ratio D/L is less than 0.1, the temperature of the coldest portion becomes difficult to be maintained in a necessary value. Then, a lighting efficiency decreases and thus a desired luminescence color is no longer obtained. Moreover, if the ratio D/L exceeds 0.3, a leak tends to occur in a sealing portion of the light-transmissive ceramic discharge vessel.

Moreover, the overall length L of the light-transmissive ceramic discharge vessel is associated with a lamp wattage W. Then letting the ratio W/L satisfy the following equation, a favorable high pressure discharge lamp can be obtained.

$$0.5 < L/W < 1.8$$

Here, if the ratio L/W is less than 0.5, a leak tends to occur in a sealing portion of the light-transmissive ceramic discharge vessel. On the other hand, if the ratio L/W exceeds 1.8, the temperature of the coldest portion becomes difficult to be maintained in a necessary value.

Furthermore, the overall length and the internal volume of the light-transmissive ceramic discharge vessel are not especially restricted. However, assuming to achieve a compact high pressure discharge lamp with a 10 to 50 W lamp wattage, and more preferably with a 10 to 30 W lamp wattage, the overall length L is desirable to be 35 mm or less, more preferably be 10 to 30 mm. Moreover, the internal volume is favorable to be 0.10 cc or less, and more particularly 0.01 to 0.08 cc.

Furthermore, the light-transmissive ceramic discharge vessel is favorable to be so designed that the highest temperature on the outer surface of the discharge vessel becomes 1,000 to 1,200 degrees C. during lamp operation.

Still in one aspect of the invention, the minimum wall-thickness Tmin of the light-transmissive ceramic discharge vessel is equal to or more than 0.1 mm. Furthermore, the minimum wall-thickness Tmin of the light-transmissive ceramic discharge vessel is favorable to be equal to or more than 0.3 mm.

These aspects of the invention specify a value for the minimum wall-thickness Tmin of the light-transmissive ceramic discharge vessel. The minimum wall-thickness influences the pressure resistance of the light-transmissive ceramic discharge vessel. It is unfavorable that the minimum wall-thickness Tmin is less than 0.1 mm, since the pressure resistance decreases extensively. By the way, it is especially favorable that the minimum wall-thickness Tmin is equal to or more than 0.1 mm from the aspect of the pressure resistance.

Therefore, according to this aspect of the invention, a high pressure discharge lamp provided with a light-transmissive ceramic discharge vessel with a sufficient pressure resistance is obtained.

Still in one aspect of the invention, the outer surface around the boundary portion between the swollen portion and the slender cylindrical portion defines a continuous concave surface.

Under the favor of that this aspect of the invention has the above configuration, the high pressure discharge lamp is able to avoid problems of decreasing mechanical strengths, such as a breakage of the light-transmissive ceramic discharge vessel, especially the slender cylindrical portion.

That is, in a configuration wherein a discontinuous inflection is defined on the outer surface around the boundary portion between the swollen portion and the slender cylindrical portion of the light-transmissive ceramic discharge vessel, and a starting-aid conductor comprised of a metal coil is wound on the slender cylindrical portion in displaced to the side of the swollen portion, cracks will likely develop due to a precursive week discharge occurring between the starting-aid conductor and the electrode inserted in the slender cylindrical portion. This tendency becomes remarkable in the case where the inner surface around the boundary portion is still defined a discontinuous inflection.

In contrast, under the favor of that in this aspect of the invention the outer surface of the boundary portion between the swollen portion and the slender cylindrical portion defines a continuous concave surface, the discharge vessel exhibits a sufficient mechanical strength even in occurrence of the precursive week discharge in the above configuration of the starting-aid conductor, and thus cracks hardly occur. Moreover, breakages hardly occur in a manufacturing process, and also cracks hardly occur in a heat cycle during the life of the discharge lamp. Meanwhile, in this aspect of the invention, the inner surface around the boundary portion between the swollen portion and the slender cylindrical portion of a light-transmissive ceramic discharge vessel may be a continuous convex surface, or may define a discontinuous inflection.

Still in one aspect of the invention, the inner diameter D of the swollen portion and the curvature radius R of the concave outer surface around the boundary portion between the swollen portion and the slender cylindrical portion are so related to each other to satisfy the following equation.

$$0.1 \leqq R/D \leqq 1.5$$

This aspect of the invention specifies a suitable configuration for the concave surface defined in the outer surface around the boundary portion between the swollen portion and the slender cylindrical portion. If the ratio R/D is less than 0.1, the mechanical strength of the boundary portion becomes week, and thus the slender cylindrical portion not only tends to break during manufacturing, but also tends to suffer with cracks due to heat cycle in lifetime. Moreover, if the ratio R/D exceeds 1.5, medium such as mercury for fixing lamp voltage in the filling becomes hard to be cooled effectively. Thus, problems tend to arise in manufacturing process.

Electrode

Electrode has a slender shape and forms a narrow gap between the inner surface of the slender cylindrical portion of the light-transmissive ceramic discharge vessel by being inserted into the slender cylindrical portion, and its distal end faces the interior of the swollen portion of the light-transmissive ceramic discharge vessel.

Meanwhile, the phrase "face the interior of the swollen portion" has a concept containing a state of the distal end lying in the swollen portion and a state of the distal end lying in the slender cylindrical portion communicating with the swollen portion. The electrode can be made by any one or an appropriate combination selected from conductive and refractory materials such as tungsten, rhenium, doped tungsten, tungsten-rhenium alloy, molybdenum, cermet etc. Furthermore, preferably, the electrode can be comprised of a slender the electrode rod and an the electrode principal part located on the distal end of the electrode rod. In this configuration, the electrode principal part is located on the distal end of the electrode rod part, and constitute an tip-end of the electrode which operates as a cathode or an anode.

The tip-end of the electrode could be wound thereon a coil made of pure-tungsten or doped-tungsten, or shaped into a head integrated with the shank part, as needed, so as to enlarge its surface area to enhance heat dissipation.

Meanwhile, the tip-end of the electrode faces the interior of the swollen portion. Here, the phrase "face the interior of the swollen portion" has a concept containing a state of the distal end lying in the swollen portion and a state of the distal and lying in the slender cylindrical portion communicating with the swollen portion.

It is desirable that the mid-portion of the electrode has a thickness as uniform as possible so as to leave a narrow gap, i.e., form a capillary between the electrode and the inner surface of the small-diameter cylinder of the light-transmissive ceramic discharge vessel. The mid-portion of the electrode could be wound thereon a coil made of pure-tungsten, rhenium, tungsten-rhenium alloy or doped tungsten. Thereby, the electrode is facilitated to be centered to the slender cylindrical portion.

The proximal end of the electrode is fixed not only to a suitable position of the light-transmissive ceramic discharge vessel so as to work for receiving power from outside, but also to the tip-end of the lead-conductor by welding or the like, so that the electrode is electrically and mechanically supported by the lead, conductor. Here, in order to buffer the heat at the sintering the material such as molybdenum could be interposed between the lead-conductor and the base end of the electrode.

According to one aspect of the inventions, a starting-aid conductor is wound on one slender cylindrical portion of the light-transmissive ceramic discharge vessel for surrounding the electrode penetrating the one slender cylindrical portion and electrically connected to have the same potential as the other electrode opposite to the former electrode.

Here, the term "opposite the electrode" means an the electrode which faces the other the electrode surrounded by the starting-aid conductor through the slender cylindrical portion through a discharge space in the swollen portion. The starting-aid conductor may be provided for both of or any one of the electrodes. For letting the starting-aid conductor have the same potential with the opposite the electrode, it suffices to connect the starting-aid conductor to the opposite the electrode through, for example, an appropriate conductor.

Lead-Conductor

The lead-conductor works for applying a voltage across the electrodes. The top end of the lead-conductor is connected to the proximal end of the electrode, and the base end is exposed to outside the light-transmissive ceramic discharge vessel. The phrase "the base end is exposed to outside the light-transmissive ceramic discharge vessel" means that it may or may not protrudes outside the light-transmissive ceramic discharge vessel, however, it has to face outside within being supplied the current from outside.

A lead-conductor could use a niobium, a tantalum, a titanium, a zirconium, a hafnium and a vanadium which are an electric leading metal having almost same average thermal expansion coefficient as that of the light-transmissive ceramic. In case of using aluminum oxide such as alumina ceramic as the material of the light-transmissive ceramic discharge vessel, since the niobium and the tantalum have almost same average thermal expansion coefficient as that of the aluminum oxide, they are suitable for sealing. In case of using the yttrium oxide and the YAG, there is no significant difference in their thermal expansion coefficients. In case of using the aluminum nitride for the light-transmissive ceramic discharge vessel, it is better to use the zirconium as the lead-conductor. They contribute to absorb impurity gas left inside the light-transmissive ceramic discharge vessel. Further, the lead-conductor is able to be used for supporting the entire of the high pressure discharge lamp by supporting the electrode.

The lead-conductor could be composed of the sealing metal rod, pipe, or coil of a niobium. In this case, since niobium etc. has an intense oxidation, an oxide-resistant conductor is connected to the lead-conductor and the lead-conductor has to be sealed by a sealant so as not to be exposed to the air when the high pressure discharge lamp is turned on in a condition that it is exposed to the air.

Filling

The filling may contain rare-gas as starting gas and buffer gas, metallic halide as luminous substance, metallic halide as lamp voltage fixing medium, and mercury as buffer vapor feed-source, by a following combination thereof. The metallic halide as luminous substance is halide of luminous-metal which emits visible light.

As the lamp voltage fixing medium, mercury or halide can be primarily used. Mercury also contributes as a luminous-metal, in a following case 3. For the halide as the lamp voltage fixing medium, metal yielding a relatively high vapor pressure during operation and a relatively little emission of visible light, for example, Al, Fe, Zn, Sb, Mn etc. is suitable. The rare-gas functions as starting gas and buffer gas. For the rare-gas, a xenon, an argon, or a krypton could be used alone or mixed with any other thereof.

By using neon and argon for the rare-gas, a glow discharge power is reduced. Thereby, a glow-arc transition time may moderately extend. In this case, argon is mixed with the neon in the rage of 0.1 to 10% in the percent pressure. Thereby, evaporation of tungsten constituting the electrodes is depressed, and thus the blackening at the start of operation is remarkably reduced. Since the starting voltage lowers in accompanying that, a lighting circuitry becomes compact in size, light in weight, and less-expensive. Moreover, the rare-gas is filled in the light-transmissive ceramic discharge vessel to exhibit a pressure more than one atmospheric pressure during the operation of the lamp. Here, in this specification the term "high pressure discharge" means a discharge wherein the pressure of the filling during the operation of the lamp becomes higher than the atmospheric pressure that is, it is a concept including a very high pressure discharge.

Further, as buffer vapor, metallic halide which yields a relatively high vapor pressure and radiating a little or little amount of visible lights, for example, aluminum halide may be filled in the discharge vessel, in place of mercury.

1. luminous-metallic halide+mercury+rare-gas: This exhibits a configuration of so-called metal halide lamp.

2. luminous-metallic halide+metallic halide as lamp voltage fixing medium+rare-gas: This exhibits a configuration of so-called mercury-free metal halide lamp avoiding use of mercury which has high environmental load.

3. mercury+rare-gas: This exhibits a configuration of so-called high pressure mercury lamp.

4. rare-gas only (in case of using Xe as the rare-gas): This exhibits a configuration of so-called xenon lamp.

As halogen for the halide of luminous-metal, it is able to use any one of iodine, bromine, chlorine and a fluorine, or any number of them in combination. The halide of luminous-metal is able to be selected from a group of known metallic halide, in order to achieve a radiation provided with a desired lighting characteristics about a luminous color, an average color rendering evaluation index Ra and a luminous efficiency, and further in response to the size and the input power of the discharge lamp light-transmissive ceramic discharge vessel For instance, one or some of halides selected among a group of Na-halide, Li-halide, Sc-halide, Tl-halide and rare-earth metallic halide could be used.

Other Configurations

In this invention, although it is not a requirement, a part or all of the following configurations are able to be provided as needed.

Sealing Compound for Ceramics

Sealing compound for ceramics can be used for closing the light-transmissive ceramic discharge vessel by sealing a gap between the slender cylindrical portion of the light-transmissive ceramic discharge vessel and the lead-conductor penetrating there-through and provided with the electrode on its distal end. For closing the discharge vessel, the sealing compound for ceramics is charged in the gap between the lead-conductor and the slender cylindrical portion from the end of the slender cylindrical portion. The sealing compound for ceramics is then melted by heating and spreads in the gap between the lead-conductor. After that the sealing compound for ceramics is solidified by cooling and consequently hermetically seals the gap between the lead-conductor and the thin cylinder portion. According to the seal, the lead-conductor is fixed to a predetermined position.

The lead-conductor is desired to be completely covered its portion lying in the thin cylinder portion with the seal. Further, when covering with the seal the proximal end of the slender the electrode fixed to the lead-conductor for a small distance, more preferably for an extent of 0.2 to 0.3 mm, the lead-conductor becomes hard to be eroded by the filling such as halogen.

Starting Aid Conductor

When the inner diameter of the swollen portion of the light-transmissive ceramic discharge vessel is enlarged relatively, and the distance between the electrodes is also relatively enlarged corresponding to enlargement of the inner diameter of the enclosure, the starting voltage of the high pressure discharge lamp tends to rise. Thus, by placing a starting-aid conductor, as needed, it is able to reduce the starting voltage. The starting-aid conductor may be a metal coil which is wound around at least one of the slender cylindrical portions through which one the electrode extends, and connected to the other the electrode to have the same potential with the other the electrode which faces the one the electrode through a discharge space in the swollen portion.

Jacket-Bulb

The high pressure discharge lamp according to the prevent invention is able to be constituted to be lighted in a state that the light-transmissive ceramic discharge vessel is exposed into air. However, if needed, it is able to accommodate the light-transmissive ceramic discharge vessel in the jacket bulb hermetically. In addition, by using the inner surface of the jacket bulb as a reflecting surface which takes its focus on the light-emitting portion of the high pressure discharge lamp, it is able to achieve a directional lighting high pressure discharge lamp.

Reflector

The high pressure discharge lamp according to the present intention is easy to collect light and advantageous in an optical configuration, since it could reduce the size of the light source as compared with an incandescent-lamp shaped fluorescent-lamp. The light source could also be integrated with a reflector, as desired. In this case, the reflector may be formed on the inner surface of the jacket bulb which accommodates the light-transmissive ceramic discharge vessel therein. Otherwise, the high pressure discharge lamp may be attached in the reflector which is formed separately. Moreover, the reflector can be provided without using the jacket-bulb.

Relation Between Diameters of Lead-Conductor and Electrode

When letting the diameters of the lead-conductor and the electrode be $\phi s$ mm and $\phi e$ mm, a following equation may be satisfied.

$$0.2 \leqq \phi e/\phi s \leqq 0.6$$

In order to prevent the corrosion of the sealant by the halides by decreasing the temperature of the sealant of the sealing compound for ceramics, and improve the lighting efficiency by increasing the temperature of the narrow gap, the heat resistance is decreased by thicken the lead-conductor in one hand, and the heat resistance of the electrode is increased in other hand. Here, if the thickness ratio $\phi e/\phi s$ is lower than 0.2, the electrode is too much thin. On the other hand, if the ratio $\phi e/\phi s$ is higher than 0.6, the temperature of the sealant and the narrow gap can not be maintained at a specific value

Relationship between Interior Volume and Linear Transmittance of Light-Transmissive Ceramic Discharge Vessel If letting the interior volume of the light-transmissive ceramic discharge vessel be 0.1 cc or less, and more preferably be 0.07 cc or less, and letting the average linear transmittance of the light-transmissive ceramic discharge vessel be 10% or more, and more particularly be 30% or more. Here, it is assumed that the linear transmittance is measured in a wavelength of 550 nm. Further, the term "average linear transmittance" means an average value of the linear transmittance data measured at different five sampling points. Furthermore, the interior volume of the light-transmissive ceramic discharge vessel is measured in a following way. First, the swollen portion is submerged in water to fill the water in the enclosure. Then the swollen portion is drawn out from water after the openings of both the thin cylinder portions having been closed. Then the volume of the water in the swollen portion is metered and measure.

In case of the light-transmissive ceramic discharge vessel having small interior volume as mentioned above, if the average linear transmittance of its envelope is 10% or more, it is able to enhance not only the optical efficiency (overall apparatus optical efficiency) including that of an optical system such as a reflector to be combined with the discharge lamp, but also to reduce occurrences of the cracks in the light-transmissive ceramic discharge vessel.

Lamp Wattage

The present invention is effective for a compact metal halide lamp with a rated lamp wattage of less than 50 W, for example, around 10 to 50 W. However, it is more effective for such lamp with 10 to 30 W of lamp wattage. Moreover, the bulb-wall load is preferable to be in the range of 15–50 $W/cm^2$.

Narrow Gap

It is effective that the narrow gap is equal to or more than 0.21 mm or more.

In order to obtain a high pressure discharge lamp of the lamp wattage lower than 50 w, compact, longer lasting and having a high lamp efficiency, it is found that it is unable to obtain a favorable discharge lamp even if the size of the conventional discharge lamp had been proportionally reduced.

So, by setting the narrow gap as mentioned above, the heat resistance of the electrode is increased, and the amount of heat transferred from the discharge plasma or the electrode is decreased, so as to decrease the temperature of the sealant. Therefore, the lamps hardly cause a leak at their sealants.

Operation

When this aspect of the invention has the above configuration, a discontinuous inflection is defined on the inner surface around the boundary portion between the swollen portion and the slender cylindrical portion of the light-transmissive ceramic discharge vessel, the boundary section thus thickened has a large thermal capacitance. As a result, the discharge space and the coldest portion are thermally isolated. Accordingly, since the transfer or halide decreases, the temperature of the coldest portion defined in the slender cylindrical portion is stabilized. Thereby, the lighting position characteristic of a high pressure discharge lamp is improved. Consequently, the maximum color-temperature change accompanying the change of lighting position can also be made within the range of ±150 degree K.

The starting-aid conductor may be comprised of a first and second metal coils which are configured as follows. That is, the first metal coil is wound around one slender cylindrical portion through which the first the electrode penetrates, and connected at its one end to the second the electrode so as to have the same potential therewith. The second metal coil is wound around the other slender cylindrical portion through which the second the electrode penetrates, and connected at its one end to the first the electrode so as to have the same potential therewith.

It is effective that the starting-aid conductors are each so provided that its one end lies in the vicinity of the boundary portion between the swollen portion and the slender cylindrical portion of the light-transmissive ceramic discharge vessel. The starting-aid conductor may be comprised of a metal coil, conductive cover layer, and etc.

Now, A preferred configuration of the starting-aid conductor which is comprised of a metal coil will be described. In implementation thereof, one or some of the following configurations are properly may be adopted.

1. Let the number of turns in the metal coil be four turns or more.

2. Let the winding pitch of the metal coil be 100 to 500%.

3. When letting the lengths of the metal coil and the slender cylindrical portion be LSA1 and LSA2, let the ratio LSA1/LSA2 be 0.3 to 1.0 (see FIG. 8).

Furthermore, since in the light-transmissive ceramic discharge vessel the inner surface around the boundary portion between the swollen portion and the slender cylindrical portion thereof defines a discontinuous inflection, and while the outer surface around there defines a continuous concave, the mechanical strength of the boundary portion is improved as described before. Thus, problems of cracks occurring around the boundary portion of the swollen portion and the slender cylindrical portion due to thermal stresses according to the precursive week discharge between the starting-aid conductor provided on the slender cylindrical portion and the electrode are reduced. Here it is to be understood that the discharge starting property of the high pressure discharge lamp is improved by providing the starting-aid conductor.

A pair of starting-aid conductors comprised of metal coils which are wound on the slender cylindrical portions of the light-transmissive ceramic discharge vessel for surrounding the electrodes penetrating the slender cylindrical portions and are asymmetrical with each other.

Here, the phrase "a pair of starting-aid conductors are asymmetrical with each other" means that they are asymmetrically constructed so as not to have the same starting-aid property. One configuration for the starting-aid properties being different from each other is realized by differing the capacitances between the starting-aid conductors and the electrodes covered by the starting-aid conductors via the slender cylindrical portions. The capacitance is varied by varying any one or more of the distance between the starting-aid conductor and the electrode, the relative dielectric constant of the slender cylindrical portion, and the effective opposing area of the starting-aid conductor and the electrode. The effective opposing area of the starting-aid conductor and the electrode can be easily chanced the effective area of the starting-aid conductor. For example, when the starting-aid conductor is comprised of a metal coil, the capacitance can be varied by changing the number of turns of the metal coil, the wire diameter of the coil wire, or the winding pitch of the metal coil.

Meanwhile, a suitable glow-arc transition time of the arc arising across the pair of the electrodes at the start of operation is about 0.5 to 3 seconds. However if the transition time is shorter than the suitable time, an electric power required for causing the glow-arc transition is supplied in a short time. Then the electrodes are over-heated, and thus an excess amount of the electrode evaporation is caused and thus accelerates the blackening. Such a phenomenon occurs by that an amount of the filling in the high temperature side slender cylindrical portion, and the grow discharge power supplied to the electrode penetrating through the high temperature side slender cylindrical portion fails to be consumed as an energy for evaporating the filling at a time of occurring a precursive week discharge.

In contrast, according to this aspect of the invention, the starting-aid conductor provided in the slender cylindrical portion, like the top side slender cylindrical portion wherein the temperature thereof rises during the operation of the lamp can be structured in asymmetrical to the opposite side starting-aid conductor so as that the capacitance associated to the top side starting-aid conductor increases.

Then, the capacitance between the asymmetrically-structured starting-aid conductor and the electrode surrounded by increases. Accordingly, the precursive week discharge current at the start of operation that starting-aid conductor by this becomes large, it follows on this and the outrider fine discharge current at the start of operation relatively increases. As a result, the energy consumed for evaporating the filling increases. Thereby, heating of the electrode is suppressed, and the blackening is also suppressed.

When this aspect of the invention has the above configuration, the maximum thickness portion serves as a heat accumulating part. According to the heat accumulation effect in that section, the change of the coldest portion temperature, i.e., the change of the color-temperature when changing the lighting position is suppressed.

Moreover, when the inner surface of the swollen portion adopts the composition which forms the continuous curved surface, distance of the central part of the bend of an arc and the inner wall of the swollen portion which counters this can be enlarged at a horizontal position lighting, and the amount of heat transferred from an arc can be reduced.

Still one aspect of the invention specifies a suitable configuration of the high pressure discharge lamp which has a relatively low lamp wattage, and thus capable of lighting at a high frequency. That is, when the rated lamp wattage 50 W or less, it is favorable that the inner diameter of the swollen portion of the light-transmissive ceramic discharge vessel is set in the range of 2 to 6 mm.

Now the reason for specifying the above range for the rated lighting frequency in one aspect of the high pressure discharge lamp will be described below. When it is a frequency lower than 15 kHz, there arises a fear of causing an audible frequency noise. When it is a frequency around 30 kHz, the frequency falls in the range which is popularly used for infra-red remote controllers. Therefore, such a frequency should not be adopted for avoiding malfunctions of infra-red remote controllers. When it is a frequency in the range in excess of 30 kHz and below 40 kHz, the frequency also falls in the range containing an acoustic-resonance mode of the light-transmissive ceramic discharge vessel. Therefore, such a frequency should not be adopted for avoiding acoustic-resonance. When it is a frequency of 50 kHz or over, an interval of the frequency which generated an acoustic-resonance becomes narrower. Therefore, it becomes difficult to adjust the frequency while considering a dispersion of the frequency of lighting circuits.

Then, this aspect of the invention can provide a low lamp wattage high pressure discharge lamp which lights at a high frequency without a practical problem, such as audible noises, acoustic-resonance, and malfunctions of infra-red remote controllers.

We also provide a luminaire useful for the high pressure discharge lamp as described above.

Here, in this application, the term "luminaire" has a wide concept containing all of such devices using lights radiated by high pressure discharge lamps for any purpose. For example, the luminaire according to this aspect of invention is able to be applied for incandescent-lamp shaped high pressure discharge lamps, lighting equipments, mobile-use head-lights, optical fiber-use light sources, image projectors, photo-chemical devicce, fingerprint discriminators, etc. Here, the term "luminaire main-body" means reminders of the luminaire from that the high pressure discharge lamp is removed.

The term "incandescent-lamp shaped high pressure discharge lamp" means a luminaire in which a high pressure discharge lamp and a stabilizer thereof are integrated together, and a bulb-base is added thereto for receiving a commercial power. By loading the bulb-base to a corresponding lamp socket, this type of lamp device is used as if it is a incandescent lamp. In case of constructing the incandescent-lamp shaped high pressure discharge lamp, it is able to provide a reflector for obtaining a required light distribution from the high pressure discharge lamp. Furthermore, it is able to provide a light diffusion glove, or a cover for moderately reducing the brightness of the high pressure discharge lamp. Furthermore, it is able to use a bulb-base having a desirable requirement. Accordingly, for replacing directly with conventional light lamps, a bulb-base the same as that of the conventional light lamps is able to be adopted.

The lighting circuit may be any configuration of an AC lighting and a DC lighting. Moreover, the AC lighting may be any configuration of a high frequency lighting and a low frequency lighting. However, as the swollen portion and the slender cylindrical portion are united in a single body of the light-transmissive ceramic discharge vessel, and the light-transmissive ceramic discharge vessel is suitable for the high sphericity configuration of the swollen portion, it is easy to avoid an influence of the acoustic resonance, the high pressure discharge lamp according to the present invention is preferable for the high frequency lighting in the range of around 5 to 200 kHz.

In the case of high frequency lighting, an inverter can be used for a high frequency generator. As the inverter, it is able to be use a various types of inverter, such as a half-bridge type inverter or a full-bridge type inverter. Although, as a current limiting impedance element, it is able to use any one of an inductance element, a capacitance element and a resistance element, or any number of them in combination, an inductance element is most preferable for a practical application. As an inductance element, it is able to use an inductor, a leakage transformer, etc. Here, in the case of the high-frequency lighting, a circuit configuration wherein a load circuit of the lighting circuit is provided with a resonance circuit which is comprised of the current limiting inductance and a capacitor, and thus the lighting circuit exhibits a load characteristics continuous from a secondary open-circuit voltage to a secondary short-circuit current is especially preferable for the lighting circuit, since it is able to make the lighting circuit compact in size and light in weight.

In contrast, in a low-frequency lighting, it is preferable that the lighting circuit is principally comprised of a step-up or step-down chopper, and a full-bridge type inverter which is energized by the DC output voltage of the chopper. In the above configuration of the lighting circuit, an inductance of the chopper works as a current limiting inductance. Therefore, the lighting circuit does not need a concrete configuration of the current limiting inductance.

Moreover, in the case of the DC lighting, a circuit configuration wherein a high pressure discharge lamp is coupled across the output terminals of the step-up or step-down chopper is preferable for the lighting circuit, since it is able to make the lighting circuit compact in size and light in weight.

Meanwhile, the lighting circuit may be mounted in the luminaire body, or on a suitable location separated from the luminaire body, for example, in the ceiling.

Further details and specific embodiments of the inventions will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION

Referring now to the attached drawings, FIGS. 2 to 14, some embodiments of the present invention will be explained hereinafter.

Figure 1:
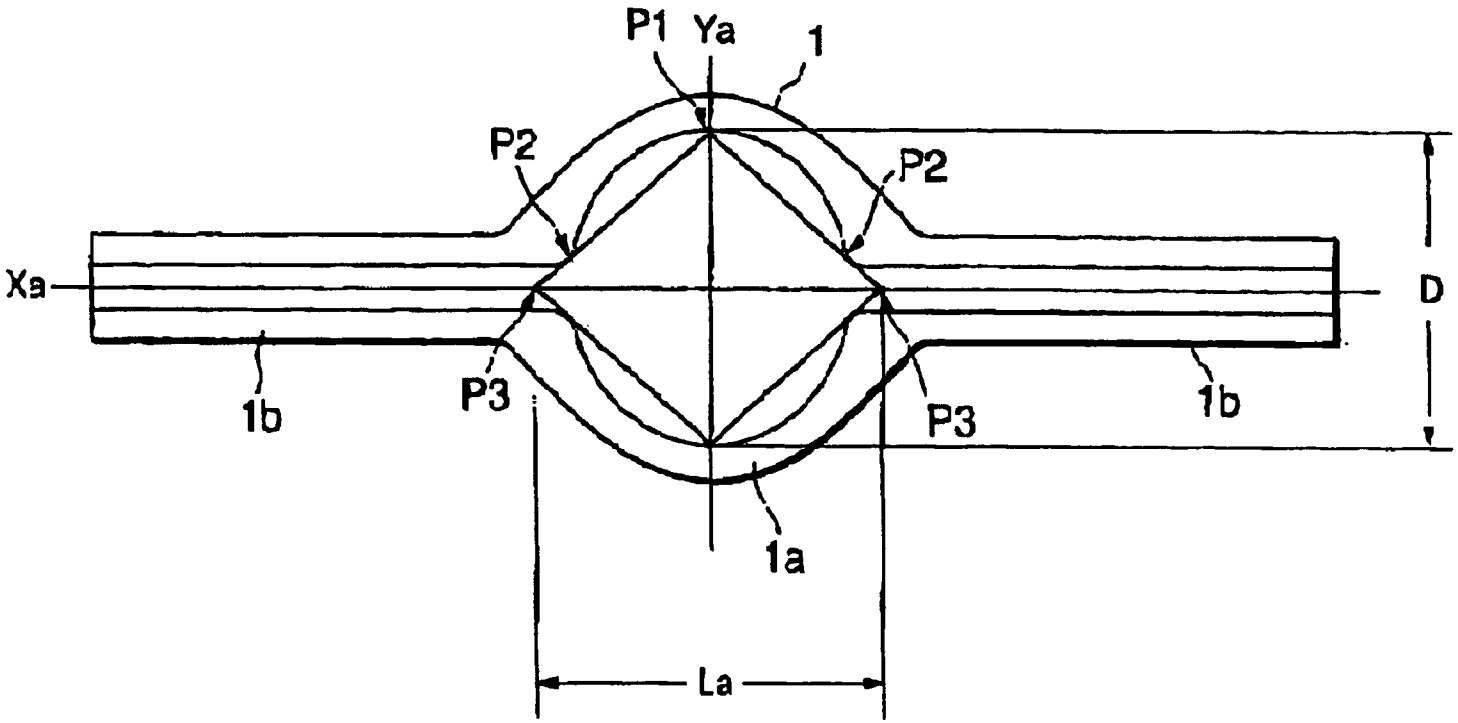
FIG. 1 is a drawing for explaining the sphericity of the swollen portion of the light-transmissive ceramic discharge according to the present invention.
Figure 2:
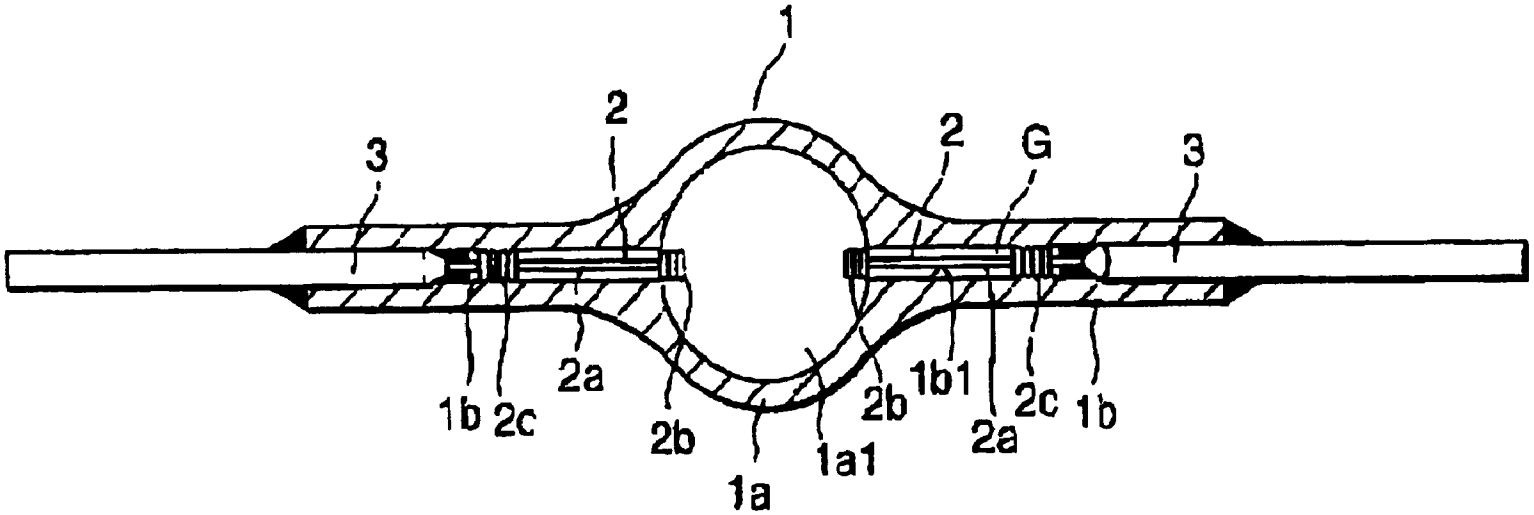
FIG. 2 is a section of a first aspect of the high pressure discharge lamp according to the present invention.
Figure 3:
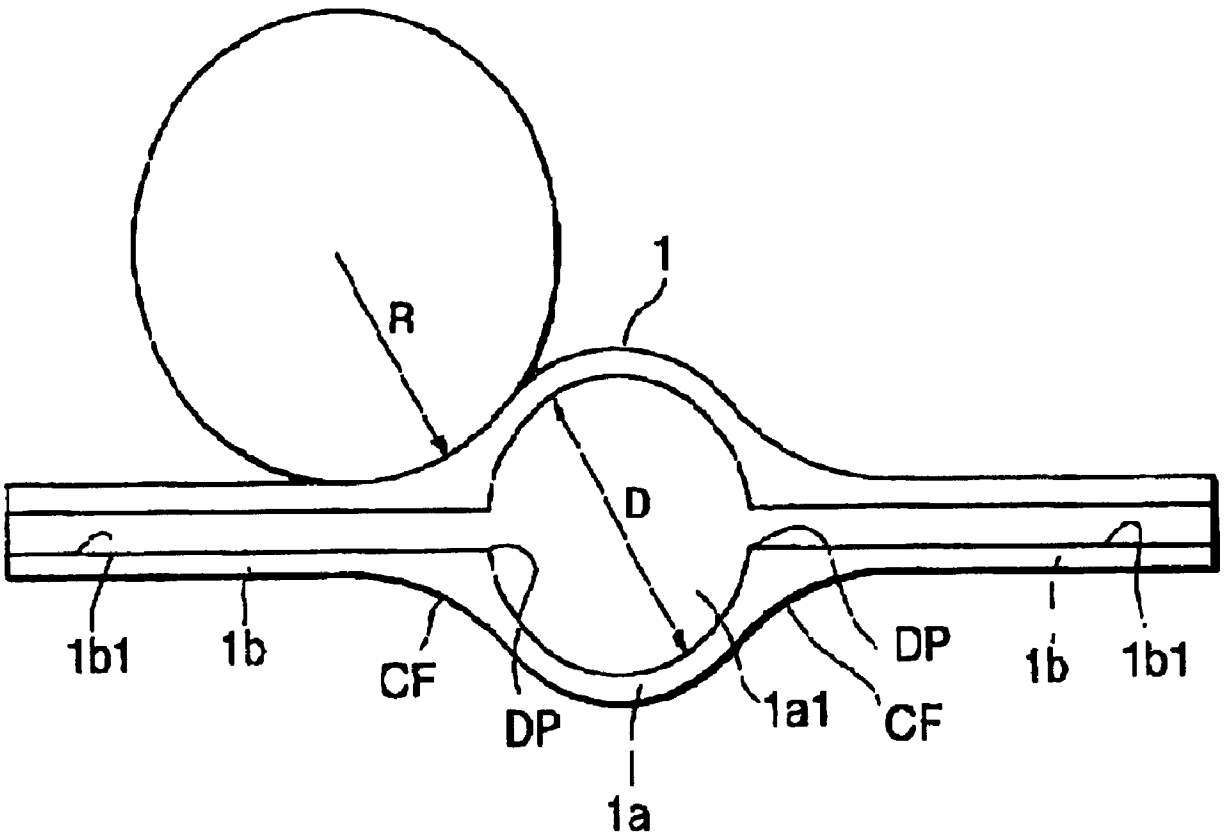
FIG. 3 is a schematic section of the light-transmissive ceramic vessel 1, shown in FIG. 2.

Firstly, FIGS. 2 and 3 show a first aspect of the high pressure discharge lamp according to the present invention.

Figure 4:
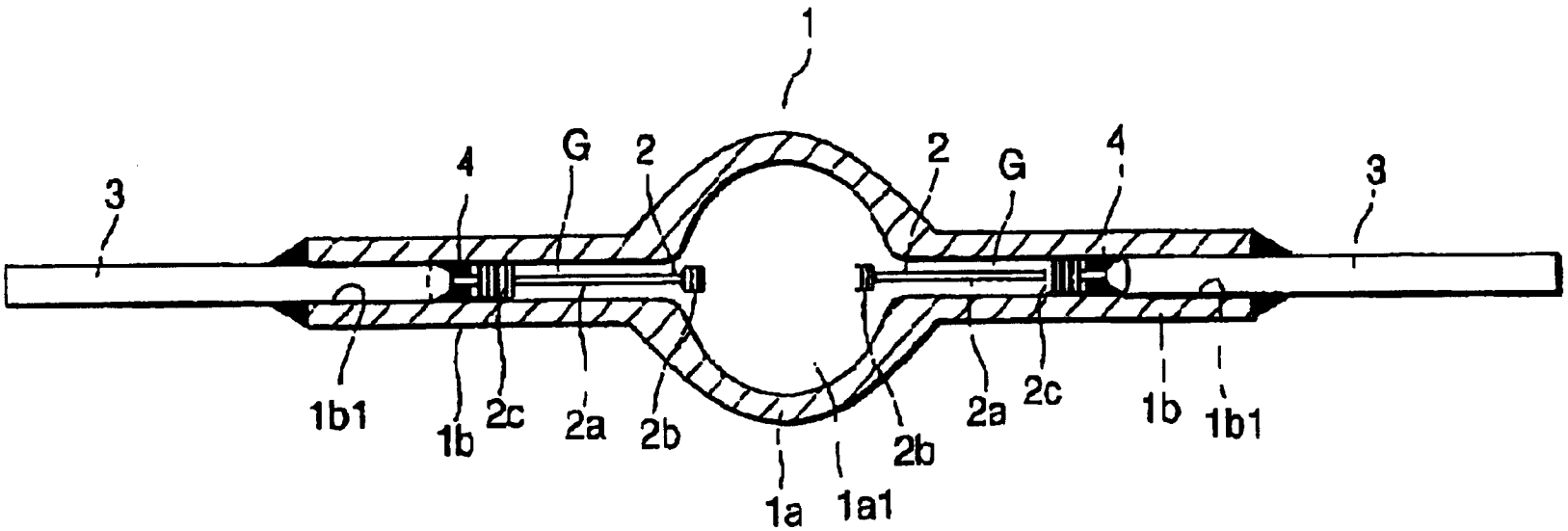
FIG. 4 is a section of a second aspect of the high pressure discharge lamp according to the present invention.
Figure 5:
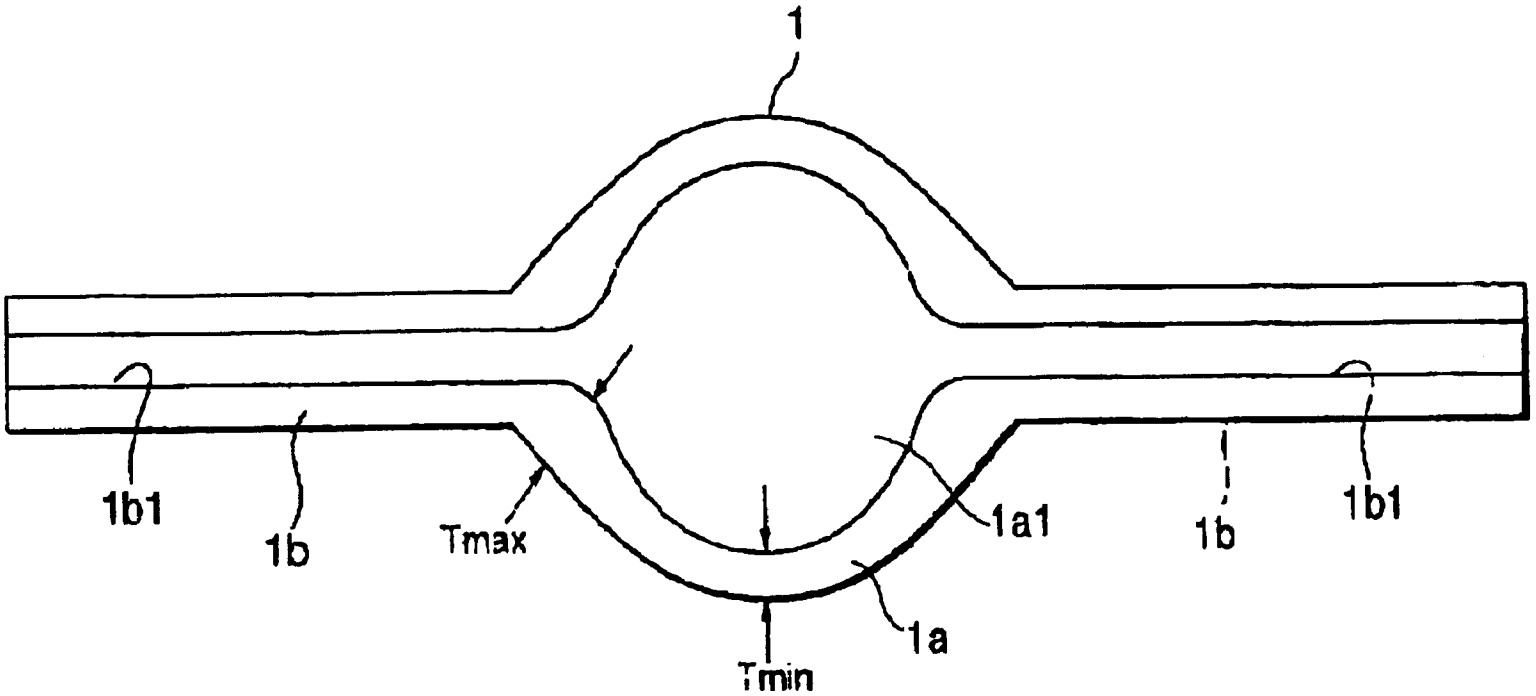
FIG. 5 is a schematic section of the light-transmissive ceramic vessel 1, shown in FIG. 4.

Secondly, FIGS. 4 and 5 show a second aspect of the high pressure discharge lamp according to the present invention.

In those drawings, the numeral "1" denotes a light-transmissive ceramic discharge vessel, the numeral 2 denotes an the electrode, the numeral 3 denotes a lead-conductor, and the numeral 4 denotes a seal. A filling is filled in the light-transmissive ceramic discharge vessel 1. Each component will be explained hereinafter in detail.

Light-Transmissive Ceramic Discharge Vessel 1

The light-transmissive ceramic discharge vessel 1 is comprised of a swollen portion 1*a* and slender cylindrical portions 1*b* which are united together in one piece in total. The swollen portion 1*a* defines a discharge space 1*a*1 in its inside. The slender cylindrical portions 1*b* define through-holes 1*b*1 in their insides. In the first aspect of the invention, as shown in FIGS. 2 and 3, the outer surface around the boundary portion of the swollen portion 1*a* and the slender cylindrical portion 1*b* defines a continuous concave surface DF, while the inner surface there around defines a discontinuous inflection DP.

On the other hand, in the second aspect of the invention, as shown in FIGS. 4 and 5, the inner surface and the outer surface of the discharge vessel are defined in gently continuous curves at the boundary portion between the swollen portion 1*a* and the slender cylindrical portion 1*b*, the boundary portion has a maximum wall-thickness Tmax and a minimum wall-thickness Tmin, and the wall-thickness ratio Tmin/Tmax is equal to or less than 0.75. The inner surface of the swollen portion 1*a* has a spherical shape, while the outer surface has a spindle shape. The slender cylindrical portion 1*b* has a shape like a take-up rod for taking up a spindle fiber. The inner surface around the boundary portion of the swollen portion 1*a* and the slender cylindrical portion 1*b* is defined in a convex surface Bi, and the outer surface there-around has an infection Bb.

Electrode 2

In the first and the second aspects of the invention, a pair of the electrodes 2, 2 are respectively shaped in a slender rod shape in total, and are each provided thereon a first coil 2*b* and a second coil 2*c*. The first coil 2*b* is wound on the distal end of the electrode rod 2*a*. The second coil 2*c* is wound on the proximal end of the electrode rod 2*a*. The electrode 2 penetrates through the through-hole 1*b*1 of the thin cylinder portion 1*b*, and the distal end thereof faces the interior space 1*a*1 of the swollen portion 1*a*, and then a narrow gap G is defined between the through-hole 1*b*1 and the electrode 2.

Lead-Conductor 3

A lead-conductor 3 which is made of niobium and shaped in a rod shape, is welded at its distal end on the proximal end of the electrode rod 2*a*. At least the mid-portion thereof is fused in the slender cylindrical portion 1*b* of the light-transmissive ceramic discharge vessel 1 through a seal 4 which will be described later. The proximal end of the lead-conductor 3 is exposed outside the light-transmissive ceramic discharge vessel 1.

Seal 4

The seal 4, which is comprised of sealing compound for ceramics, lies in between the slender cylindrical portion 1*b* of the light-transmissive ceramic discharge vessel 1 and the lead-conductor 3. The seal 4 hermetically seals the light-transmissive ceramic discharge vessel 1 and fuses the lead-conductor 3 by melting and then solidifying the sealing compound for ceramics. Further, the seal 4 is sealing the slender cylindrical portion 1*b* so as not be exposed inside the swollen portion 1*a*. The seal 4 is also fixing the electrode in a predetermined position.

In order to form the seal 4, sealing compound for ceramics is applied around the lead-conductor 3 at around a portion thereof exposing outside the through-hole 1*b*1 and the end surface of the slender cylindrical portion 1*b*. The sealing compound for ceramics is melted by heat, thus the fluid of the sealing compound for ceramics runs inside the gap G between the lead-conductor 3 and the through-hole 1*b*1. Then the fluid covers the circumference of the portion of the lead-conductor 3 lying in the through-hole 1*b*1 and the proximal end of the electrode 2. After that the fluid is solidified by cooling.

Filling

A filling to be filled in the light-transmissive ceramic discharge vessel 1 is comprised of starting gas and buffer gas including rare-gas, e.g., neon and argon, halide of luminous-metal, and mercury for feeding the buffer gas by releasing there-from. The filling may contain rare-gas working as the starting gas and the buffer gas, metallic halide working as luminous substance, metallic halide working as lamp voltage fixing medium, and mercury working as buffer vapor feed-source, at a following combination thereof.

EXAMPLE I

Light-transmissive ceramic discharge vessel 1: Made of light-transmissive alumina ceramics; 23 mm in overall length Swollen portion 1*a:* 6.0 mm in the maximum outer diameter; 5.0 mm in the maximum inner diameter Thin cylindrical portion 1*b:* 1.7 mm in outer diameter; 0.7 mm in the maximum inner diameter D Boundary portion between Swollen portion 1*a* and Thin cylindrical portion 1*b:* 4 mm in curvature radius R of the concave outer surface CF Electrode 2: Made of doped tungsten Electrode rod 2*a* of upper side electrode 2: 0.25 mm in diameter; 5.8 mm in length Electrode rod 2*a* of lower side electrode 2: 0.2 mm in diameter; 5.8 mm in length First coil 2*b*: Made of doped tungsten; 0.135 mm in diameter; 4 turns of closed-winding Second coil 2*c*: Made of doped tungsten; 0.25 mm in diameter; 4 turns of closed-winding Lead-conductor 3: Made of niobium; 0.64 mm in diameter Small gap G: 0.225 mm Filling: 3% of Ne+about 27 kPa of Ar as operating gas and buffer gas; and a proper quantity of mercury and iodide of Na, Tl, Dy as luminous-metal (luminous-metal halide is filled in the swollen portion by an amount that the metallic halide does not completely evaporate, but surplus of the metallic halide stays in the narrow gap)

Lamp wattage: 20 W

Total luminous flux: 1,800 lm

Lighting efficiency: 90 lm/W

Color-temperature: 3,500 K

Rated life: 8,000 h

EXAMPLE II

Light-transmissive ceramic discharge vessel 1: Made of light-transmissive alumina ceramics; 23.1 mm in overall length Swollen portion 1*a:* 6.0 mm in the maximum outer diameter; 5.0 mm in the maximum inner diameter Thin cylindrical portion 1*b:* 1.7 mm in outer diameter; 0.7 mm in maximum inner diameter D Boundary portion between Swollen portion 1*a* and Thin cylindrical portion 1*b:* 4 mm in curvature radius R of the concave outer surface CF Electrode 2: Made of doped tungsten Electrode rod 2*a* of upper side electrode 2: 0.2 mm in diameter; 2.5 mm in length First coil 2*b*: Made of doped tungsten; 0.16 mm in diameter; 4 turns of closed-winding Second coil 2*c*: Made of doped tungsten; 0.13 mm in diameter; 70 turns of closed-winding Inter-electrode distance: 3.5 mm Lead-conductor 3: Made of niobium; 0.64 mm in diameter Filling: 3% of Ne+about 13 kPa of Ar as operating gas and buffer gas; about 2 mg of mercury and 2.0 mg of iodide of Na, Tl, Dy as luminous-metal Lamp wattage: 21 W Total luminous flux: 1,800 lm Lighting efficiency: 90 lm/W Color-temperature: 3,000 K Rated life: 8,000 h

EXAMPLE III

Light-transmissive ceramic discharge vessel 1: Made of light-transmissive alumina ceramics; 23 mm in overall length Swollen portion 1*a:* 6.0 mm in the maximum outer diameter; 5.0 mm in the maximum inner diameter; Maximum wall-thickness Tmax=1 mm; Minimum wall-thickness Tmin=0.5 mm; Wall thickness ratio Tmin/Tmax=0.5

Thin cylindrical portion 1*b:* 1.7 mm in outer diameter; Maximum inner diameter D=0.7 mm Electrode 2: Made of doped tungsten Electrode rod 2*a* of upper side electrode 2: 0.25 mm in diameter; 5.8 mm in length Electrode rod 2*a* of lower side electrode 2: 0.2 mm in diameter; 5.8 mm in length First coil 2*b*: Made of doped tungsten; 0.135 mm in diameter; 4 turns of closed-winding Second coil 2*c*: Made of doped tungsten; 0.25 mm in diameter; 4 turns of closed-winding Lead-conductor 3: Made of niobium; 0.64 mm in diameter Small gap G: 0.225 mm Filling: 3% of Ne+about 27 kPa of Ar as operating gas and buffer gas; and a proper quantity of mercury and iodide of Na, Tl, Dy as luminous-metal (luminous-metal halide is filled in the swollen portion by an amount that the metallic halide does not completely evaporate, but surplus of the metallic halide stays in the narrow gap)

Lamp wattage: 20 W

Total luminous flux: 1,800 lm

Lighting efficiency: 90 lm/W

Color-temperature: 3,500 K

Rated life: 8,000 h

EXAMPLE IV

Light-transmissive ceramic discharge vessel 1: Made of light-transmissive alumina ceramics; 23 mm in overall length Swollen portion 1*a:* 6.0 mm in the maximum outer diameter; 5.0 mm in the maximum inner diameter; Maximum wall-thickness Tmax=1.2 mm; Minimum wall-thickness Tmin=0.5 mm; Wall thickness ratio Tmin/Tmax=0.42

Thin cylindrical portion 1*b:* 1.7 mm in outer diameter; Maximum inner diameter D=0.7 mm Other components: The same as those in the above example III.

Figure 6:
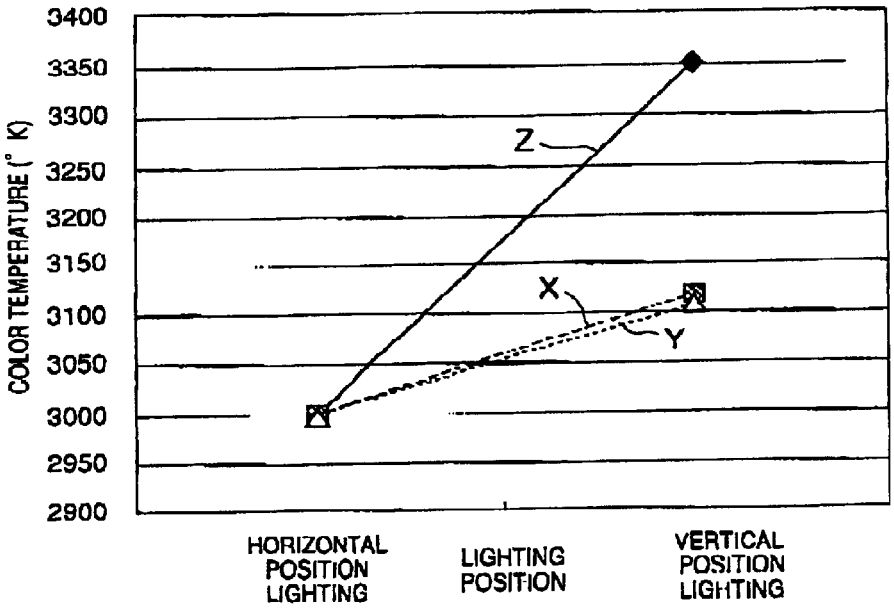
FIG. 6 is a graph showing measurement data of color temperatures of the second aspect of the high pressure discharge lamp according to the present invention and comparative examples when changing their lighting position.

Referring now to FIG. 6, measurement data of color temperatures of the second aspect of the high pressure discharge lamp according to the present invention when changing their lighting position will be described in comparison with comparative examples. In FIG. 6, an axis of abscissa (x-axis) indicates the lighting position and an axis or ordinates (y-axis) indicates the color temperature by degree K. Moreover, the curve "X" plots the characteristics of the example I. The curve "Y" plots the characteristics of the example II. While, the curve "Z" plots the characteristics of the comparative example. Here, the comparative example associated to the curve "Z" has the same specification as the examples I and II, except that the wall thickness of the light-transmissive ceramic discharge vessel is almost uniform within a clearance of 0.5 mm over the whole length thereof.

As seen from FIG. 6, in every examples of the second aspect of the invention, the color temperature change is remarkably decreased in comparison with the comparative examples.

EXAMPLE V

Light-transmissive ceramic discharge vessel 1: Made of light-transmissive alumina ceramics; 316 mm in overall length Swollen portion 1*a:* 6.0 mm in the maximum outer diameter; 5.0 mm in the maximum inner diameter; Maximum wall-thickness Tmax=1.0 mm; Minimum wall-thickness Tmin=0.5 mm; Wall thickness ratio Tmin/Tmax=0.5

Thin cylindrical portion 1*b:* 1.7 mm in outer diameter; 0.7 mm in maximum inner diameter D Electrode 2: Made of doped tungsten Electrode rod 2*a* of upper side electrode 2: 0.2 mm in diameter; 2.5 mm in length First coil 2*b*: Made of doped tungsten: 0.16 mm in diameter; 4 turns of closed-winding Second roil 2*c*: Made of doped tungsten; 0.13 mm in diameter; 70 turns of closed-winding Inter-electrode distance: 3.5 mm Lead conductor 3: Made of niobium; 0.64 mm in diameter Filling; 3% of Ne+about 13 kPa of Ar as operating gas and buffer gas; about 2 mg of mercury and 2.0 mg of iodide of Na, Tl, Dy as luminous-metal.

Lamp wattage: 21 W

Total luminous flux: 1,800 lm

Lighting efficiency: 90 lm/W

Color-temperature: 3,000 K

Rated life: 8,000 h

Figure 7:
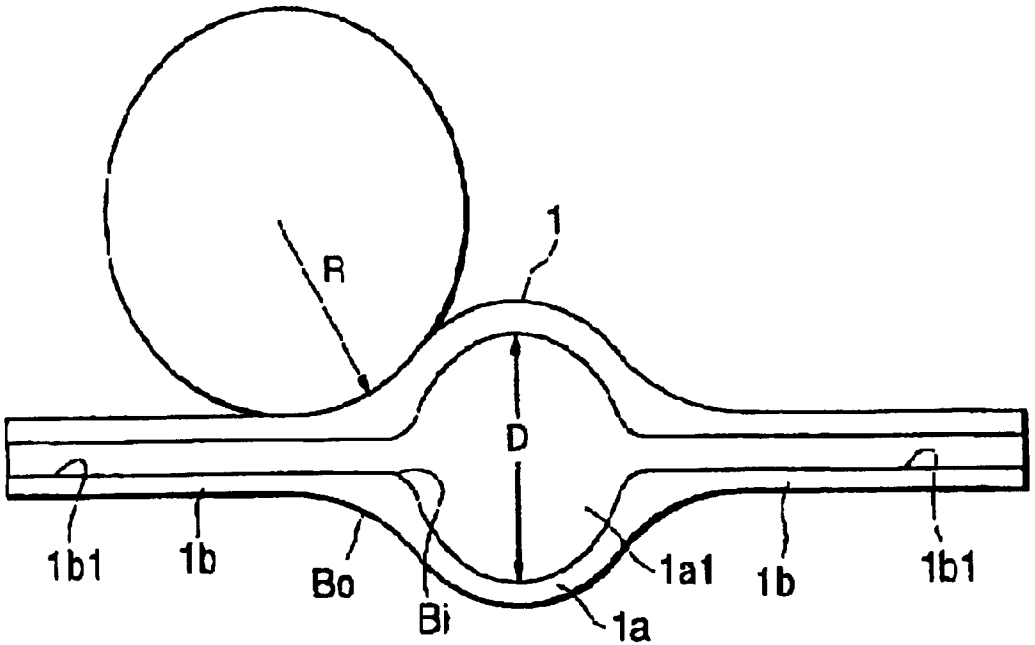
FIG. 7 is a schematic section of the light-transmissive ceramic vessel of a third aspect of the high pressure discharge lamp according to the present invention.

FIG. 7 shows in section the light-transmissive ceramic vessel of the third aspect of the high pressure discharge lamp according to the present invention. In FIG. 7, the same elements as those, as shown in FIGS. 3 and 5, are assigned with the like reference numerals and not discussed herein.

This third aspect of the invention differs from the second aspect of the invention in that the outer surface around the boundary portion between the swollen portion 1*a* and the slender cylindrical portion 1*b* of the light-transmissive ceramic discharge lamp 1 is shaped in a concave surface B0. That is, in contrast to that in the second aspect, as shown in FIG. 5, an inflection is defined on the boundary portion, the boundary portion in this third aspect is formed in the concave surface B0 at an appropriate curvature. For example, some dimensions are defined as follows, i.e., the radius of curvature R−4 mm; the inner diameter D=5 mm; and their ratio R/D=0.8.

Figure 8:
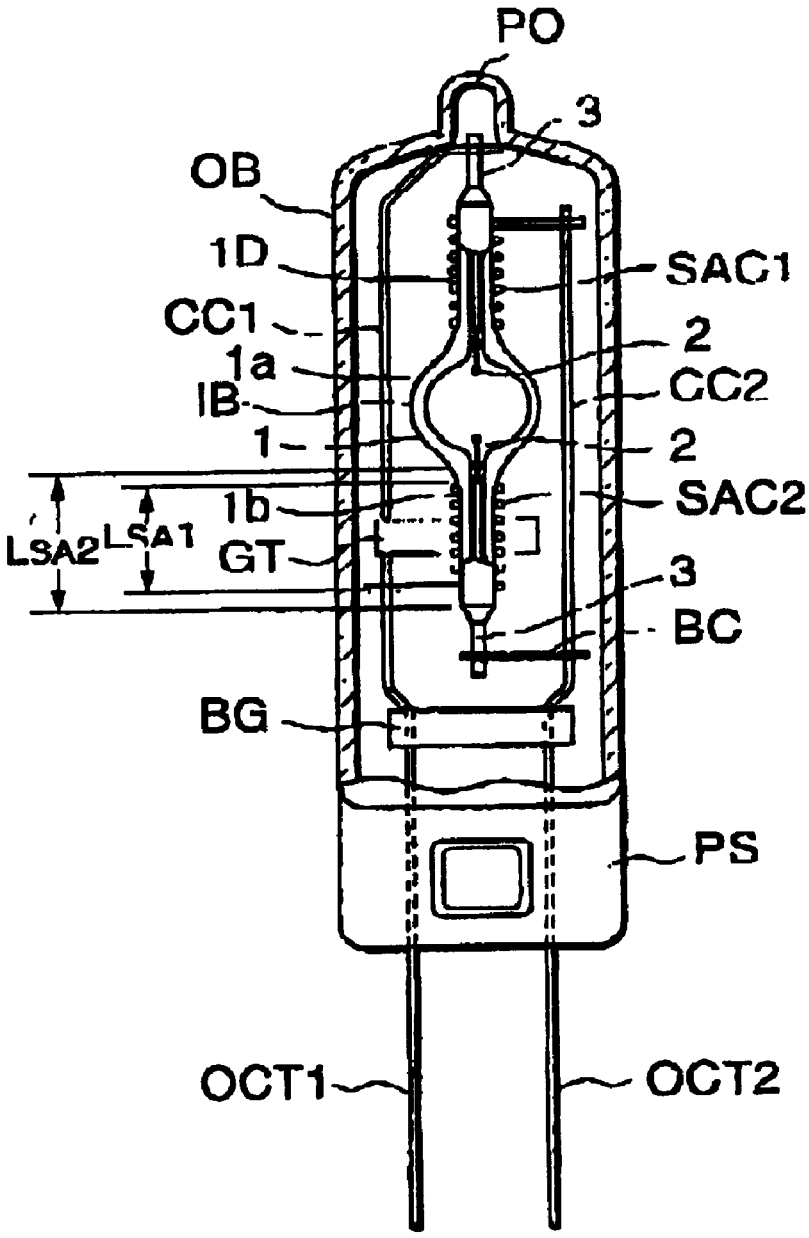
FIG. 8 is a partial cut-away front section of a fourth aspect of the high pressure discharge lamp according to the present invention.

Referring now to FIG. 8, a fourth aspect of the high pressure discharge lamp according to the present invention will be described. In FIG. 8, the same elements as those, as shown in FIGS. 2 and 4, are assigned with the like reference numerals and not discussed herein. This fourth aspect of the invention differs from the first to third aspects of the invention in that the high pressure discharge lamp is configured in a two-tier structure and provided with first and second starting-aid conductors SAC1, SAC2. That is, a high pressure discharge lamp is comprised of a lighting-source bulb IB, first and second suspension conductors CC1, CC2 and a bridging wire-rod BC, a bead glass BG, first and second starting-aid conductors SAC1, SAC2, a jacket-bulb OB, a getter GT, and outer lead terminals OCT1, OCT2.

The lighting-source bulb IB has the same structure as the high pressure discharge lamp, as shown, in FIG. 7. Here, since the metallic halide and the mercury are filled in the light-transmissive ceramic discharge vessel 1 excessively over the evaporating amount, some of them stay in a narrow gap G in a liquid-phase during the stable lighting. Then the surface of the liquid-phase filling becomes the coldest portion.

The first and second suspension conductors CC1, CC2 are respectively made of molybdenum, and they extend approximately in parallel on both sides of the lighting-source bulb IB in the axial direction of the jacket-bulb OB. The distal end of the first suspension conductor CC1 is coupled to the lead-conductor 3 of the upper the electrode 2, while the mid-portion thereof extends in parallel to and separately from the axial direction of the light-transmissive ceramic discharge vessel. The second suspension conductor CC2 is coupled to the lead-conductor 3 of the lower the electrode 2 via the bridging wire rod BC.

The bead glass BG holds the first and second suspension conductors CC1, CC2 in a predetermined distance, by glass-fusing the lower parts of the first and second suspension conductors CC1, CC2. The starting-aid conductors SAC1, SAC2 are coils of 0.3 mm thickness molybdenum wires respectively wound on the slender cylindrical portions 1*b* by 6.5 turns. The upper side starting-aid conductor SAC1 has the same potential as the lower side electrode 2 by being wound on the upper side slender cylindrical portion 1*b*, and connected to the second suspension conductors CC2. The lower side starting-aid conductor SAC2 has the same potential as the upper the electrode 2 by being wound on the lower side slender cylindrical portion 1*b*, and connected to the first suspension conductors CC1.

The jacket-bulb OB is made of the T-shaped hard glass bulb. A pinch-sealed portion PS is formed at the outside end of the jacket-bulb OB, and an exhaust pinch-off portion PO is formed at the distal end of the jacket-bulb OB. The interior of the jacket-bulb is in the lower exhausted condition around $1.3\times10^{-2}$ PA. The pinch-sealed portion PS is formed by pinching the opening of the type-T bulb when the opening is softened by the heating. The exhaust pinch-off portion PO is a trace which had been left after exhausting the jacket-bulb OB through an exhaust pipe and pinching-off the pipe.

The getter GT is made of ZrAl alloy, and it is supported by the first suspension conductor CC1 by welding.

The outer lead terminals OCT1, OCT2 are comprised of the lower ends of the suspension conductors CC1, CC2 which extend outside by hermetically penetrating the pinch-sealed portion PS of the jacket-bulb OB.

Figure 9:
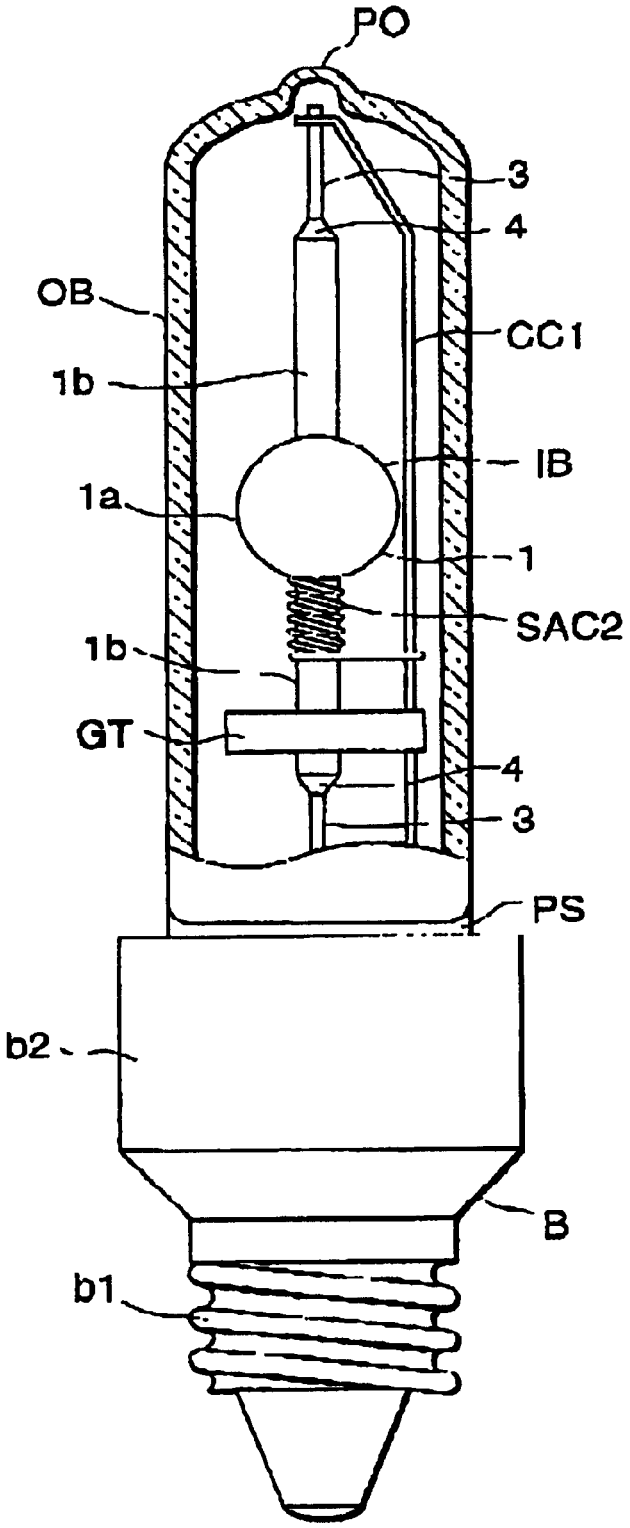
FIG. 9 is a partial front section of a fifth aspect of the high pressure discharge lamp according to the present invention.

Referring now to FIG. 9, a fifth aspect of the high pressure discharge lamp according to the present invention will be described. This fifth aspect of the invention differs from the fourth aspect of the invention in that a bulb-base B is provided to the jacket bulb OB, and that only the starting-aid conductor SAC2 is provided on the lower side (bottom on FIG. 9) slender cylindrical portion of the discharge vessel 1.

The bulb-base B is comprised of a type-E11 screw-base conductor b1 and a ceramic body b2. The type-E11 screw-base conductor b1 is appropriately connected to a pair of lead-conductors (not shown). The ceramic body b2 holds the type-E11 screw-base conductor b1 on its one end. While the ceramic body b2 is adhered to the pinch seal section PS of the jacket-bulb OB with inorganic adhesive (not shown).

The starting-aid conductor SAC2 has seven turns.

The fifth aspect of the high pressure discharge lamp has the same type of bulb-base with halogen lamps. Therefore, it is favorable for a light source alternative to the halogen lamps.

Figure 10:
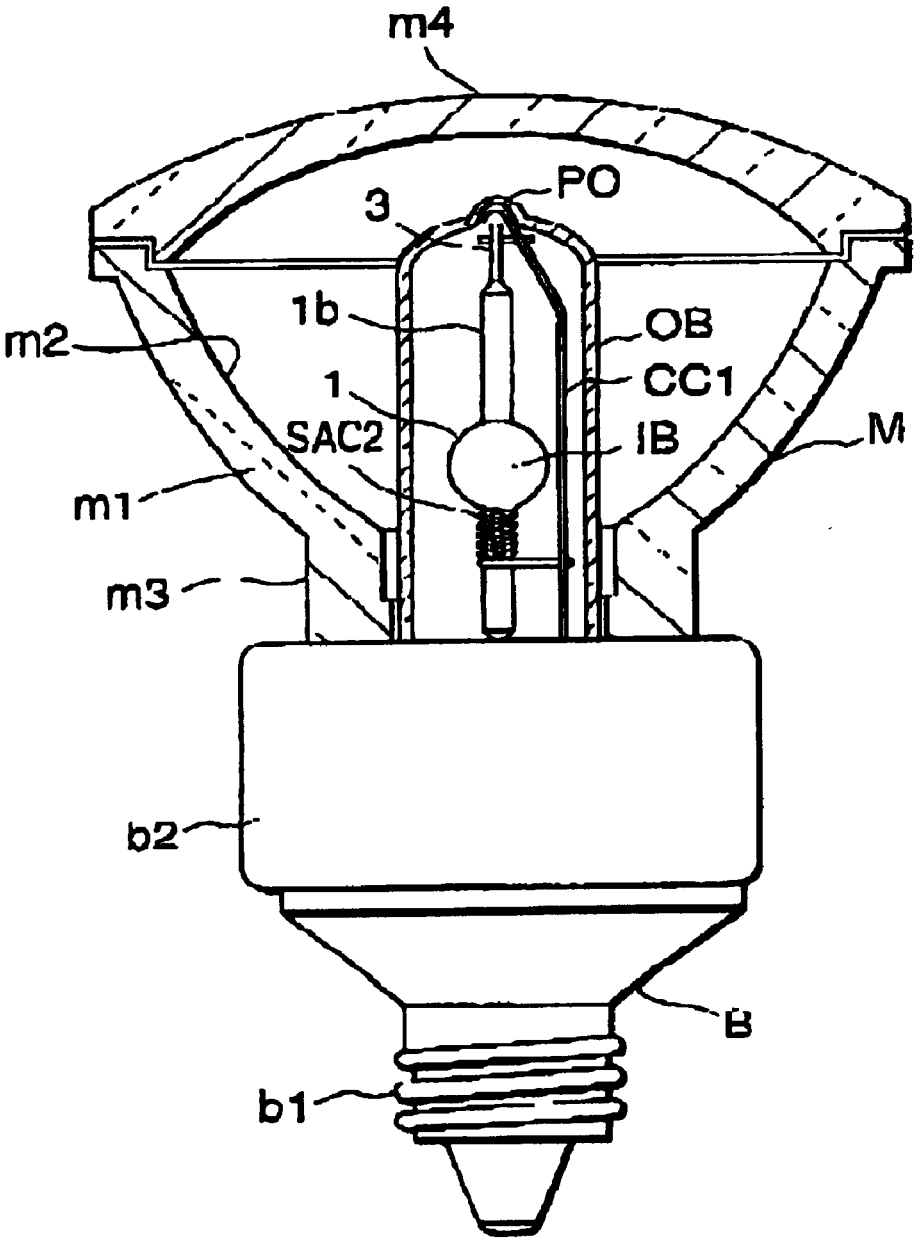
FIG. 10 is a partial front section of a sixth aspect of the high pressure discharge lamp according to the present invention.

Referring now to FIG. 10, a sixth aspect of the high pressure discharge lamp according to the present invention will be described. In FIG. 10, the same elements as those, as shown in FIG. 9, are assigned with the like reference numerals and not discussed herein. This sixth aspect of the invention differs from the fifth aspect of the invention (see FIG. 9) by that a reflector M and a front glass for closing the open end of the reflector M are further provided.

The reflector M is comprised of a glass base m1, a dichroic reflective surface m2, and a cylindrical portion m3. The glass base m1 is formed in integral with the cylindrical portion m3. The dichroic reflective surface m2 is a layer of infrared ray transmissive and visible radiation reflective, which is formed on the inner surface of the glass base m1 by vapor deposition. The cylindrical portion m3 protrudes in the backward direction from the bottom end of the glass base m1. The front glass m4 closes the light projection opening of the glass base m1 by being adhered on the peripheral with in organic adhesive.

The bulb-base B has a ceramic base b2 which is adhered to the cylindrical portion m4 of the reflector M with inorganic adhesive (not shown) in coaxial with the reflector M and the jacket-bulb OB of the high pressure discharge lamp 1.

Since this sixth aspect of the high pressure discharge lamp has the same type of bulb-base with the general halogen lamp with mirrors, it is favorable for a light source alternative to the halogen lamp with mirrors for luminaire, such as down-lights and spot-lights.

Figure 11:
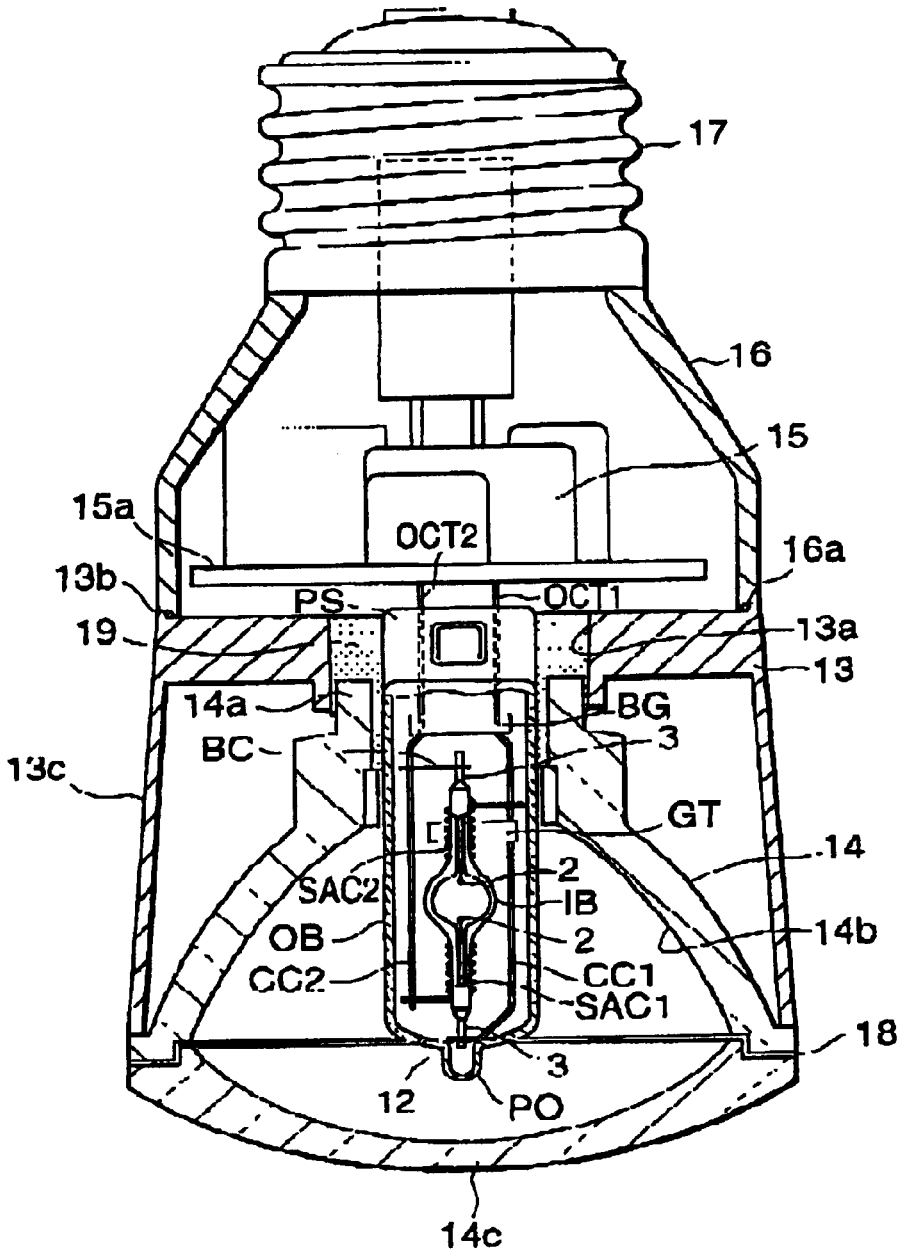
FIG. 11 is a partial front section of a seventh aspect of the high pressure discharge lamp embodied as an incandescent-lamp type discharge lamp according to the present invention.

Referring now to FIG. 11, an incandescent-lamp shaped high pressure discharge lamp as one aspect of the present invention will be described. In FIG. 11, the incandescent-lamp shaped high pressure discharge lamp is comprised of a high pressure discharge lamp 12, a pedestal 13, a reflector 14, a high frequency lighting circuitry 15, the base body 16, and a screw-type bulb-base 17. The above components of the incandescent-lamp shaped high pressure discharge lamp will be respectively explained hereinafter.

High Pressure Discharge Lamp 12

The high pressure discharge lamp 12 has almost the same specifications as the high pressure discharge lamp, as shown in FIG. 8. In FIG. 11, outer lead terminals OCT1 and OCT2 protrude upward from the pinch-scaled portion PS of the jacket bulb OB. By the way, in FIG. 11, the same elements, as those shown in FIGS. 8 and 9, are assigned with the same marks and omitted the explanation.

Pedestal 13

The pedestal 13 is made of heat-resistant synthetic resin. The pedestal 13 has a mounting hole 13*a* in its center portion, a mounting portion 13*b* around its upper peripheral portion and a conical skirt 13*c* on its lower peripheral portion. The mounting hole 13*a* is adapted for mounting the high pressure discharge lamp 12 and the reflector 14 on the pedestal 13. The pinch-sealed portion PS of the high pressure discharge lamp 12 and the outside end 14*a* of the reflector 14 are inserted into the mounting hole 13*a* and then fixed thereto inorganic adhesive 19. The mounting portion 13*b* is fixed to the opening edge of the base body 16. The conical skirt 13*c* covers the reflector 14 for protection thereof and enhancing its appearance.

Reflector 14

The reflector 14 is placed around the high pressure discharge lamp 12 and covers at least the light emitting portion, that is the swollen portion 1*a* of the high pressure discharge lamp 12. Accordingly the reflector 14 is fixed on the pedestal 13. In the present embodiment as mentioned above, the high pressure discharge lamp 12 is fixed on the pedestal 13 together with the reflector 14. Further, the reflector 14 is formed in a bowl shape by glass and has a cylindrical edge 14*a* integrally-formed with the top of the bowl. And a reflecting surface 14*b* in formed on the inner surface of the bowl-shape reflector by an evaporated aluminum film. The edge portion 14*a* is inserted into the mounting hole 13*a* of the pedestal 13, and then fixed to the pedestal 13 through the inorganic adhesive 19. Further, a front glass 14*c* is mounted on the opening portion of the reflector 13. The front glass 14*c* is made of transparent glass, and hermetically sealed to the reflector 14 through frit glass 18 with a low melting point. Furthermore, nitrogen as inert-gas is filled in the space defined by the reflector 14 and the front glass 14*c*.

High Frequency Lighting Circuitry 15

In the position as shown in FIG. 11, the high frequency lighting circuitry 15 is mainly mounted on the upper side of the wiring board 15*a* in the drawing. And it accepts the outer lead terminals OCT 1 and OCT 2 of the high pressure discharge lamp 12 from the lower side of the wiring board 15*a* so as to appropriately connect to the wiring board 15*a*.

Base Body 16

The base body 16 is shaped like a cup. A screw-type bulb-base 17 as described below is coupled to the upper end of the base body 16, and a circumferential step 16*a* is defined on the opening edge of the base body 16. Further the base body 16 accommodates therein the lighting circuitry 15. Further, the circumferential step 13*c* of the pedestal 13 fits into the circumferential step 16*a* of the opening edge and then they are fixed by the inorganic adhesive 19. Here, holes or gape for draining air out or dissipating heat are defined at a right place on the base body 16 or a fitting place thereof to the pedestal, as needed.

Screw-Type Bulb-Base 17

The screw-type bulb-base 17 is comprised of the type-E26 screw-base, and mounted on the upper end of the base body 16.

Figure 12:
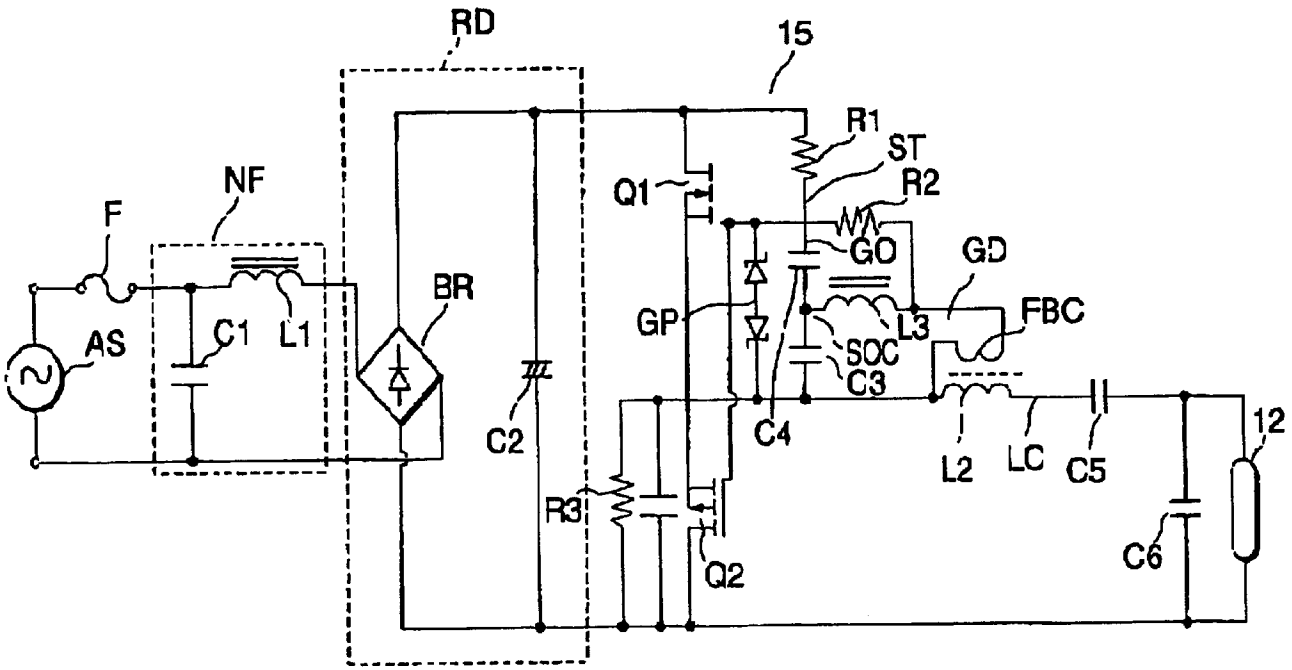
FIG. 12 is a circuit diagram showing a high-frequency lighting circuitry 15, shown in FIG. 11.

Referring now to FIG. 12, a circuit configuration of a high frequency lighting circuitry 15 will be described.

In FIG. 12, the high frequency lighting circuitry 15 is comprised of an AC power source AS, an over-current fuse f, a noise filter NF, a rectification type DC power source RD, a high frequency inverter HFI, and a load circuit LC. Herein-below, the components will be separately described.

The AC power source AS is a commercial 100 V power source.

The over-current protection fuse F is a print fuse formed on a printed circuit board, and it protects the circuit not to be burnt when an excessive current has flown in the circuit.

The noise filter NF is comprised of an inductor L1 and a capacitor C1, and eliminates high-frequency components occurring with the operation of the high-frequency inverter from their leak to the power supply side.

The rectified DC power source RD is comprised of a bridge rectifier BR and a smoothing capacitor C2. AC input terminals of the bridge rectifier BR are coupled to an AC power source A via the noise filter NF and the over-current protection fuse f, and DC output terminals are coupled across a smoothing capacitor C2, output a smoothed DC current.

The high frequency inverter HFI is comprised of a half bridge inverter, and it is provided with a first and a second switching elements Q1, Q2, a gate drive circuit GC, a starting circuit ST, and a gate protection circuit GT. The first switching element Q1 is comprised of an N-channel MOSFET whose drain is connected to a positive polarity terminal of the smoothing capacitor C2. The second switching element Q2 is comprised of a P-channel MOSFET whose source is connected to the source of the first switching device Q1, while whose drain is connected to a negative polarity terminal of the smoothing capacitor C2. Accordingly, the first and the second switching elements Q1 and Q2 are connected in series in order, and their respective polarity terminals are connected across the output terminals the rectified DC power source RD.

The gate drive circuit GD is comprised of a feedback circuit FBC, a series resonator SOC, and a gate voltage output circuit GO. The feedback circuit FBC is comprised of an auxiliary winding which is magnetically coupled to a current limiting inductor L2. The series resonator SRC is comprised of a series circuit of an inductor L3 and a capacitor C3 which is connected across the feedback circuit FBC. The gate voltage output circuit GO is constituted for outputting a resonance voltage appearing across the capacitor C3 of the series resonant circuit SO via a capacitor C4.

Then, one end of the capacitor C4 is coupled to the connection node of the capacitor C3 and the inductor L3, while the other end of the capacitor C4 is coupled to the gates of the first and the second switching elements Q1 and Q2. Further, the other end of the capacitor C3 is coupled to the sources of the first and the second switching devices Q1 and Q2. Accordingly, the resonance voltage applied to both ends of the capacitor C3 is applied across the gates and the sources of the first and the second switching devices Q1 and Q2 via the gate voltage output circuit GO.

The starting circuit ST is comprised of resistors R1, R2 and R3. One end of the resistor R2 is connected to the positive terminal of the smoothing capacitor C2, and the other end is connected to the gate of the first switching device Q1 and to one end of the resistor R2 and to the output end at the side of the gate of the gate voltage output circuit GO of the gate driving circuit GD, i.e., the other end of the capacitor C4. The other end of the resistor R2 is connected to the connection node of the inductor L3 of the series resonance circuit SOC and the feedback circuit FBC. One end of the resistor R3 is connected to both of the first and the second switching devices Q1 and Q2, i.e., the sources of the switching devices Q1 and Q2 and the source of the gate voltage output circuit GO. While the other end of the resistor R3 is connected to the negative terminal of the smoothing capacitor C2.

The gate protection circuit GP is comprised of a pair of zener diodes connected in series and their opposite pole terminals connected each other, and is connected in parallel to a gate voltage output circuit GO.

The load circuit LC is comprised of a series circuit of the high pressure discharge lamp HD, the current limiting inductor L2 and a DC-blocking capacitor C5, and a resonance capacitor C6 which is connected in parallel to the high pressure discharge lamp HD. One end of the load circuit LC is connected to the connection node of the first and the second switching devices Q1 and Q2, and the other end is connected to the drain of the second switching device Q2. The current limiting inductor L2 and the resonance capacitor C6 constitute a series resonance circuit. Here, the DC-blocking capacitor C5 has a large capacitance, and thus does not significantly affect to the series resonance.

A capacitor C7 connected across the drain and the sources of the second switching device Q2 reduces a load during the switching operation of the second switching device Q2.

Now the operation of the lighting circuitry will be explained.

When the AC power source AS is powered-on, the DC voltage smoothed by the rectified DC power source RD appears across the smoothing capacitor C2. Then, the DC voltage is applied between both drains of the first and the second switching devices Q1 and Q2 which is connected in serial. However, both switching means Q1 and Q2 are turned off since the gate voltage is not applied.

Since the DC voltage as mentioned above is applied to the starting circuit ST at the same time, the voltage according to the proportional distribution of the resistance of the resistors R1, R2 and R3 principally is applied to both ends of the resistor R2. Then, the terminal voltage of the resistor R2 is applied across the gate and the source of the first and the second switching devices Q1 and Q2 as the positive voltage.

As a result, since the first switching device Q1 is set to exceed the threshold voltage it turns-on. On the other hand, since the voltage applied across the gate and the source of the second switching device Q2 has a polarity opposite to the gate voltage, the second switching device Q2 stays in a turned-OFF state.

When the first switching device Q1 turns ON, a current flows to the load circuit LC from the rectification DC supply source RD via the first switching device Q1. Thereby, the higher resonance voltage appears across the terminals of the resonance capacitor C6 due to the resonance of the series resonator of the current limiting inductor L2 and the resonance capacitor C6, and then the resonance voltage is applied to the high pressure discharge lamp HPL.

On the other hand, by the current flowing in the current limiting inductor L2 a voltage is induced in the feedback circuit FBC which magnetically couples to the current limiting inductor L2. Thereby, since a boosted negative voltage is generated in the capacitor C3 by the series resonance of the series resonator SRC, the voltage is clipped to a fixed voltage in the gate protection circuit GP, and applied across the gate and the source of the first and the second switching devices Q1 and Q2 via the gate voltage output circuit GO.

Thereby, since the clipped fixed voltage exceeds the threshold voltage of the second switching device Q2, the second switching device Q2 turns ON.

On the contrary, the first switching device Q1 turns-off since the gate voltage is reversed its polarity.

When the second switching device Q2 turns ON, electromagnetic energy stored in the current limiting inductor L2 of the load circuit LC and charge stored in the capacitor C6 are released, and a current flows in the reverse direction in the load circuit LC from the current limiting inductor L2 via the second switching device Q2. Then a reverse polarity high resonant voltage appears across the capacitor C6 and then applied to the high pressure discharge lamp HPL. After that, the operations as mentioned above is repeated. The operation frequency of the high frequency inverter HFI is 150 kHz. The high pressure discharge lamp 12 starts operation and lights the lamp without any acoustic resonance.

Now, the specification of the above embodiment of the lamp will be described.

Outer diameter: 50 mm

Overall length: 110 mm

Bulb-base: Type-E26

Rated voltage: 100 V

Power dissipation: 23 W

Maximum intensity of light: 4200 Cd

Beam divergence: 28 degrees

Beam flux: 780 lm

Rated life: 8,000 hr

Figure 13:
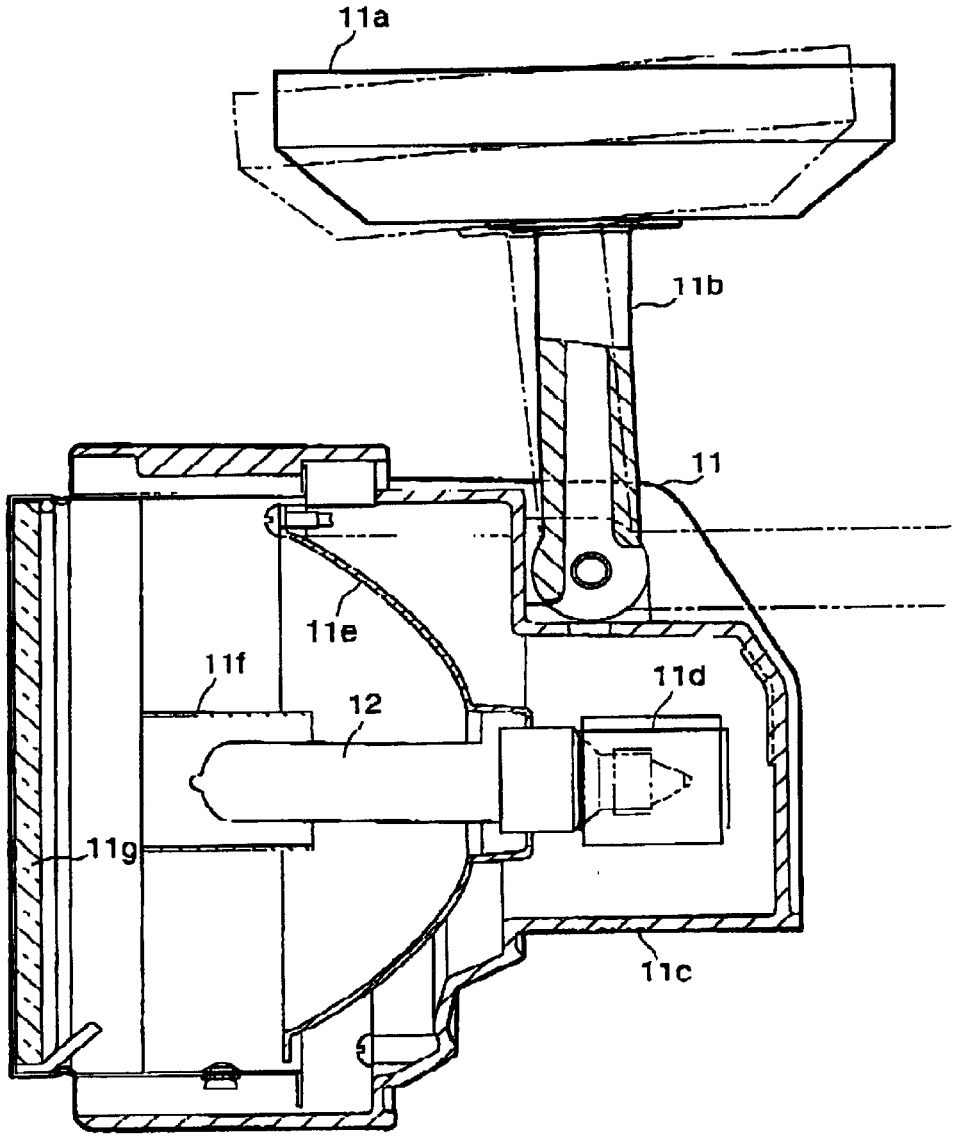
FIG. 13 is a partial section of a first aspect of luminaire embodied as a spot-light according to the present invention.

Referring now to FIG. 13, a spotlight as a first aspect of the luminaire according to the present invention will be described. FIG. 13 shows a partial section front view of the spotlight. This aspect of spotlight is comprised of a spotlight main-body 11, a high pressure discharge lamp 12, and a high frequency lighting circuit (not shown). The high frequency lighting circuit is separated from spotlight main-body 11.

The spotlight main-body 11 is mainly provided with a ceiling base 11*a*, an arm 11*b*, a main-body housing 11*c*, a lamp socket 11*d*, a reflector 11*e*, a light-shield cylinder 11*f* and a front glass 119. The ceiling base 11*a* hangs the spotlight by mounted on the ceiling, and it is coupled to the lighting circuit (not shown) which is mounted behind the ceiling to receiving the power. The base of the arm 11*b* is fixed to the ceiling base 11*a*. The main-body housing 11*c* has an opening at its front, and is pivoted on the free-end of the arm 11*b* in freely rockable in a vertical plane. Here, the range that the arm 11*b* is able to rock in reference to the main-body housing 11*c* is illustrated by the long dashed double-short dashed line in FIG. 18. The lamp socket 11*d*, which fits to the type-E11 screw-base, is placed inside the main-body housing 11*c*. The reflector 11*e* is placed in front of the lamp socket 11*d*, and mounted on the main-body housing 11*c*. The light-shield cylinder 11*f* is mounted on the middle portion of the opening edge of the reflector 11*e*. The front glass 119 is mounted on the opening edge of the main body housing 11*c*.

The high pressure discharge lamp 12 has the same specifications as those, as shown in FIG. 9. The high pressure discharge lamp 12 is installed to the spotlight main-body 11 by mounting the screw-base of the high pressure discharge lamp 12 to the lamp socket 11*d*. Further, the light-shield cylinder 11*f* shields the light coming from the inside end of the jacket-bulb OB when the high pressure discharge lamp 12 is installed to the spotlight main-body, so as to prevent glare.

Figure 14:
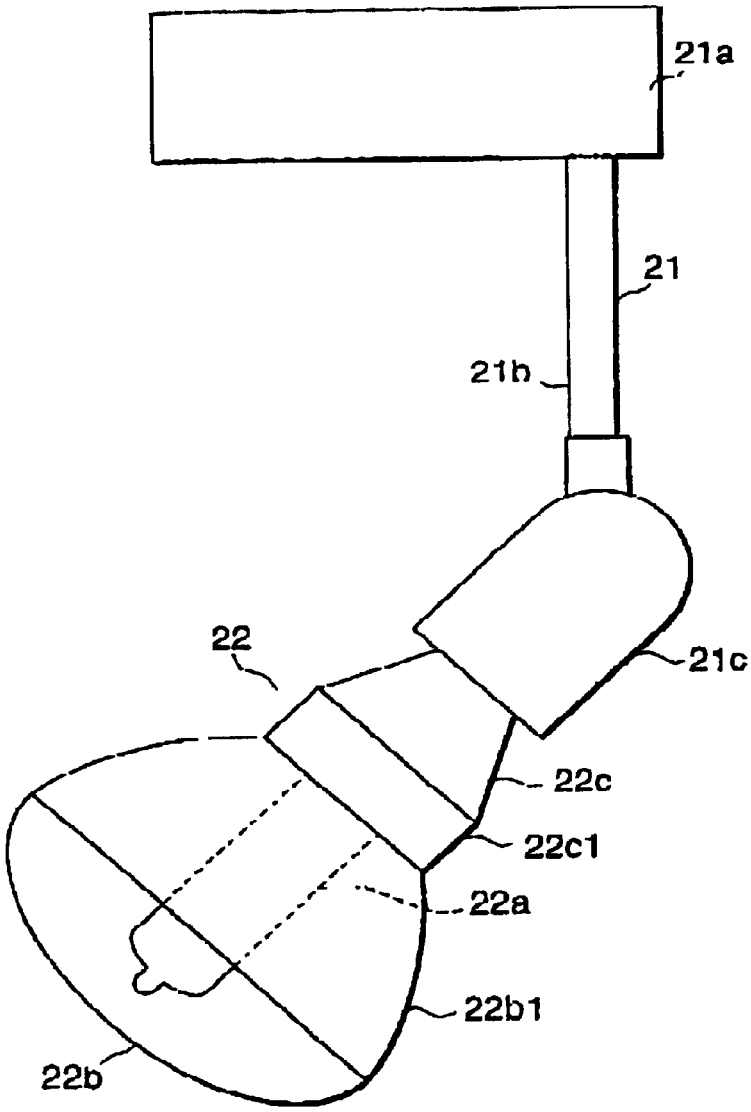
FIG. 14 is a front view of a second aspect of the luminaire embodied as another spot-light according to the present invention.

FIG. 14 is a front view of the spot-light as a second aspect of luminaire according to the present invention. In FIG. 14, the numeral "21" denotes a luminaire main-body, and the numeral "22" denotes a high pressure discharge lamp.

The luminaire main-body 21 is provided with a fixing base 21*a*, a supporting post 21*b*, and a lighting body 21*c*.

The fixing base 21*a* is configured to be hanged directly from a ceiling or hanged via the lighting induct, and it is accommodating the discharge lamp lighting device (not shown) inside. The supporting post 21*b* supports the lighting body 21*c* by suspending it from the fixing base 21*a*. The supporting post 21*b* accommodates therein an insulator-coating lead-wire (not shown) for connecting the discharge lamp lighting device to the lighting body 21*c*. The lighting body 21*c* accommodates therein a lamp socket (not shown).

The high pressure discharge lamp 22 is provided with a high pressure discharge lamp main-body 22*a*, a reflector-coating glass bulb 22*b*, and a bulb-base 22*c*. The high pressure discharge lamp main-body has the same specification as that shown in FIG. 9. The reflector-coating glass bulb 22*b* is constituted by coating an aluminum vapor deposition reflector 22*b*1 on the inner surface of the type-R glass bulb except the front portion thereof. The bulb-base 22 is comprised of a screw-base conductor 22*c* and a ceramic base 22*c*2. The screw-base conductor is a type-E26 bulb-base. The high pressure discharge lamp main-body 22*a* and the reflector-coating glass bulb 22*b* are equipped with it while the lamp socket currently provided in the core of the lighting body 21*c* is equipped. The ceramic base 22*c*2 is fixed with the screw-base conductor, and then fixes the high pressure discharge lamp main-body 22*a* and the base portion of the reflector-coating glass bulb 22 coaxially received thereto with an inorganic adhesive.

By loading the bulb-base 22*c* of the high pressure discharge lamp 22 into the lamp socket of the lighting body 21*c*, the high pressure discharge lamp 22 lights at a high luminance. As the light from the high pressure discharge lamp 22 is then collected on the aluminum vapor deposition reflector 22*b*1 of the reflector-coating glass bulb 22*b*, the luminaire is able to effectually illuminate an object at a desired sharp luminous intensity distribution characteristics. Therefore, this embodiment of the high pressure discharge lamp 22 is favorable for replacing with conventional mercury reflector lamp for spotlights using thereof.

According to one aspect of the invention, the thermal capacity of the boundary portion between the swollen portion and the slender cylindrical portion increases. Thereby, the discharge space and the coldest portion are thermally isolated, and the transfer of halide decreases. Thus, the temperature of the coldest portion defined in the slender cylindrical portion is stabilized, and the lighting position characteristic of a high pressure discharge lamp is improved.

According to still another aspect of the inventions, a light-transmissive ceramic discharge vessel with a sufficient pressure resistance is obtained.

According to still another aspect of the inventions, an effect that the mechanical strength of the boundary portion between the swollen portion and the slender cylindrical portion increases is also achieved.

According to still another aspect of the inventions, it becomes possible to light the high pressure discharge lamp at a frequency getting out of the acoustic-resonance frequency.

According to still another aspect of the inventions, the luminaire is able to enjoy the various advantages according to the aspect of the high pressure ceramic discharge lamps.

As described above, the inventions can provide an extremely preferable high pressure discharge lamp and a luminaire.

While there have been illustrated and described what are at present considered to be preferred embodiments of the inventions, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

The foregoing description and the drawings are regarded by the applicant as including a variety of individually inventive concepts, some of which may lie partially or wholly outside the scope of some or all of the following claims. The fact that the applicant has chosen at the time of filing of the present application to restrict the claimed scope of protection in accordance with the following claims is not to be taken as a disclaimer or alternative inventive concepts that are included in the contents of the application and could be defined by claims differing in scope from the following claims, which different claims may be adopted subsequently during prosecution, for example, for the purposes of a divisional application.

What is claimed is:

1. A luminaire, comprising:

a luminaire main-body;

a high pressure discharge lamp with a rated lamp wattage equal to or less than 50 W, which is mounted on the luminaire main-body; and a lighting circuit for driving the high pressure discharge lamp, at a rated lighting frequency in the range of 15 to 30 kHz or the range of 40 to 50 kHz., the lamp including:

a light-transmissive ceramic discharge vessel having a swollen portion defining a discharge space and a pair of slender cylindrical portions formed in integral with the swollen portion and communicating with the swollen portion at opposite ends of the swollen portion, wherein the inner surface of the boundary portion between the swollen portion and the each slender cylindrical portion defines a continuous curved surface;

a pair of electrodes which penetrate the slender cylindrical portions of the light-transmissive ceramic discharge vessel and having distal ends which lie in the swollen portion of the light-transmissive ceramic discharge vessel;

lead-conductors connected to the proximal ends of the electrodes, sealed in the light-transmissive ceramic discharge vessel at least at their mid-portions and exposing outside from the light-transmissive ceramic discharge vessel at their proximal ends; and a filling filled in the light-transmissive ceramic discharge vessel, wherein the inner surface of the swollen portion of the light-transmissive ceramic discharge vessel has an almost spherical shape, wherein the wall-thickness ratio Tmin/Tmax of the minimum wall-thickness Tmin and the maximum wall-thickness Tmax of the light-transmissive ceramic discharge vessel is equal to or less than 0.75, wherein the outer surface of the boundary portion between the swollen portion and the each slender cylindrical portion defines a continuous concave surface, wherein the inner diameter D of the swollen portion and the curvature radius R of the concave outer surface around the boundary portion between the swollen portion and the slender cylindrical portion satisfies a following equation $0.1 \leqq R/D \leqq 1.5$.

2. A high pressure discharge lamp, comprising:

a light-transmissive ceramic discharge vessel having a swollen portion defining a discharge space and a pair of slender cylindrical portions formed in integral with the swollen portion and communicating with the swollen portion at opposite ends of the swollen portion, wherein the inner surface of the boundary portion between the swollen portion and the each slender cylindrical portion defines a continuous curved surface;

a pair of electrodes which penetrate the slender cylindrical portions of the light-transmissive ceramic discharge vessel and having distal ends which lie in the swollen portion of the light-transmissive ceramic discharge vessel;

lead-conductors connected to the proximal ends of the electrodes, sealed in the light-transmissive ceramic discharge vessel at least at their mid-portions and exposing outside from the light-transmissive ceramic discharge vessel at their proximal ends; and a filling filled in the light-transmissive ceramic discharge vessel, wherein the inner surface of the swollen portion of the light-transmissive ceramic discharge vessel has an almost spherical shape, wherein the wall-thickness ratio Tmin/Tmax of the minimum wall-thickness Tmin and the maximum wall-thickness Tmax of the light-transmissive ceramic discharge vessel is equal to or less than 0.75, wherein the outer surface of the boundary portion between the swollen portion and the each slender cylindrical portion defines a continuous concave surface, wherein the inner diameter D of the swollen portion and the curvature radius R of the concave outer surface around the boundary portion between the swollen portion and the slender cylindrical portion satisfies a following equation $0.1 \leqq R/D \leqq 1.5$.

3. A high pressure discharge lamp as claimed in claim 2, wherein the minimum wall-thickness Tmin of the light-transmissive ceramic discharge vessel is equal to or more than 0.1 mm.

4. A high pressure discharge lamp as claimed in claim 2, wherein the minimum wall-thickness Tmin of the light-transmissive ceramic discharge vessel is equal to or more than 0.8 mm.

5. A high pressure discharge lamp according to claim 2, wherein the rated lamp wattage is equal to or less than 50 W, and the rated lighting frequency is in the range of 15 to 30 kHz or the range of 40 to 50 kHz.

* * * * *